US007006060B2

(12) United States Patent
Kanazawa et al.

(10) Patent No.: US 7,006,060 B2
(45) Date of Patent: Feb. 28, 2006

(54) PLASMA DISPLAY PANEL AND METHOD OF DRIVING THE SAME CAPABLE OF PROVIDING HIGH DEFINITION AND HIGH APERTURE RATIO

(75) Inventors: Yoshikazu Kanazawa, Kawasaki (JP); Hitoshi Hirakawa, Kawasaki (JP); Shigeharu Asao, Kawasaki (JP); Shinsuke Tanaka, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 328 days.

(21) Appl. No.: 09/998,897

(22) Filed: Dec. 3, 2001

(65) Prior Publication Data

US 2002/0067321 A1 Jun. 6, 2002

Related U.S. Application Data

(63) Continuation-in-part of application No. 09/785,272, filed on Feb. 20, 2001, now abandoned.

(30) Foreign Application Priority Data

Jun. 22, 2000 (JP) ..... 2000-188256
Apr. 5, 2001 (JP) ..... 2001-107624

(51) Int. Cl.
*G09G 3/28* (2006.01)

(52) U.S. Cl. ..... 345/66; 345/60; 345/67; 315/169.4

(58) Field of Classification Search ..... 345/60–63, 345/66, 68, 74.1, 76, 67; 315/167–168, 169.1, 315/169.3, 169.4; 313/484, 491, 514, 517, 313/520, 584, 586–587
See application file for complete search history.

(56) References Cited

U.S. PATENT DOCUMENTS

| | | | | |
|---|---|---|---|---|
| 6,140,984 | A * | 10/2000 | Kanazawa et al. | 345/67 |
| 6,208,082 | B1 * | 3/2001 | Kim et al. | 315/169.1 |
| 6,288,692 | B1 * | 9/2001 | Kanazawa et al. | 345/67 |
| 6,292,160 | B1 | 9/2001 | Mikoshiba et al. | |
| 6,392,344 | B1 * | 5/2002 | Hong | 313/586 |
| 6,404,411 | B1 * | 6/2002 | Masuda et al. | 345/66 |
| 6,603,446 | B1 * | 8/2003 | Kanazawa et al. | 345/60 |

FOREIGN PATENT DOCUMENTS

| | | |
|---|---|---|
| EP | 0 680 067 A2 | 11/1995 |
| EP | 0 762 373 | 3/1997 |
| EP | 0 762 373 A2 | 3/1997 |
| EP | 0 810 577 A1 | 12/1997 |
| EP | 0 929 062 | 7/1999 |
| EP | 0 959 451 A2 | 11/1999 |
| EP | 0 965 975 | 12/1999 |
| JP | 09-062225 | 3/1997 |

(Continued)

*Primary Examiner*—Ricardo Osorio
*Assistant Examiner*—Mansour M. Said
(74) *Attorney, Agent, or Firm*—Staas & Halsey LLP

(57) ABSTRACT

A display panel has a plurality of first electrodes, a plurality of second electrodes disposed adjacently and alternately with the first electrodes, a plurality of third electrodes formed to cross the first and second electrodes, and a control circuit for carrying out an address discharge during the second electrodes and the third electrodes. The control circuit carries out a sustain discharge to decrease the volume of wall charges, accumulated on a display cell in which a sustain discharge is not intended, to a level which cannot generate a sustain discharge.

32 Claims, 30 Drawing Sheets

FOREIGN PATENT DOCUMENTS

| | | |
|---|---|---|
| JP | 9-311661 | 12/1997 |
| JP | 2000-075835 | 3/2000 |
| JP | 2000-122601 | 4/2000 |
| JP | 2000-39867 | 6/2000 |
| JP | 2001-272949 | 10/2001 |
| TW | 397963 | 5/1997 |

* cited by examiner

[ODD FIELD]

PLASMA DISPLAY PANEL AND METHOD OF DRIVING THE SAME CAPABLE OF PROVIDING HIGH DEFINITION AND HIGH APERTURE RATIO

CROSS REFERENCE TO RELATED APPLICATION

This application is a continuation-in-part application of Ser. No. 09/785,272 filed on Feb. 20, 2001 now abandoned.

BACKGROUND OF THE INVENTION

1. Field of the Invention

The present invention relates to a plasma display panel and, more particularly, to a plasma display panel of the ALIS system and a method of driving this plasma display panel.

2. Description of the Related Art

Recently, as a plasma display panel (PDP) that is capable of providing high definition and a high aperture ratio, there has been proposed a PDP of the ALIS (Alternate Lighting of Surfaces) system. In such a PDP of the ALIS system, information display, such as display of characters, is often carried out by repeatedly using only one field in order to avoid flickering. This entails the risk that an abnormal discharge may occur due to a distorted accumulation of electric charges on the display panel. Therefore, there has been a strong demand for the provision of a technique, for driving a PDP, capable of preventing the occurrence of such an abnormal discharge.

Specifically, in a PDP of the ALIS system, when only one field, for example an odd field, is used to carry out a display of information such as characters, for example, the address discharge is always in the same direction. When this driving (display) is repeated, a distortion in the electric charge occurs on the display panel. This abnormal discharge can prevent normal operation thereafter, and can damage the driving circuit by breaking an insulation film with a large voltage.

The prior art and the problems associated with the prior art will be described in detail, later, with reference to the accompanying drawings.

SUMMARY OF THE INVENTION

One object of the present invention is to provide a plasma display panel and a method of driving the same capable of preventing an abnormal discharge by eliminating a distorted accumulation of electric charges on the display panel. It is another object of the present invention to provide a plasma display panel, and a method of driving the same, capable of preventing an erroneous address operation caused by only applying an erasing pulse without applying an address pulse during an address period.

According to the present invention, there is provided a method of driving a plasma display panel having a plurality of first electrodes, a plurality of second electrodes adjacently disposed alternately, and a plurality of third electrodes formed to cross the first and second electrodes, comprising the steps of carrying out an address discharge between the second electrodes and the third electrodes; carrying out an auxiliary discharge to decrease the volume of wall charges, accumulated on a display cell in which a sustain discharge is not intended, to a level which cannot generate a sustain discharge; and carrying out a sustain discharge by alternately applying sustain pulses to the first and second electrodes.

The method of driving the plasma display panel may further comprise the steps of generating a discharge in a selected cell by applying a voltage pulse, with the third electrodes set to have a first polarity and the second electrodes set to have a second polarity; carrying out an address discharge to form wall charges of a first polarity on at least the second electrodes, with the first electrodes set to have a first polarity with respect to the second electrodes, and also to form wall charges of a second polarity on the first electrodes; and applying a voltage pulse to the first or third electrodes or to both electrodes so as to set the third electrodes to have a first polarity and to set the first electrodes to have a second polarity, thereby generating a discharge in a discharge cell that starts a discharge without application, to this cell, of a voltage pulse that brings about an address discharge through the third electrodes.

A voltage to be applied to the third electrodes when carrying out the auxiliary discharge may be equivalent to a voltage of an address pulse for carrying out an address discharge. A voltage to be applied to the second electrodes when carrying out the auxiliary discharge may be a voltage which decreases a potential difference between the voltage applied to the second electrodes and a voltage of an additional pulse to be applied to the first electrodes. The voltage to be applied to the second electrodes when carrying out the auxiliary discharge may be equivalent to a voltage of a nonselected electrode of the second electrodes during an address period. The first electrodes and the second electrodes may be disposed, in parallel, alternately and the third electrodes may be orthogonal with the first and second electrodes.

The method of driving the plasma display panel may further comprise the steps of applying a voltage pulse, having the same polarity as a voltage pulse for carrying out the address discharge, between the second electrodes and the third electrodes; and carrying out a further auxiliary discharge to decrease the volume of wall charges, accumulated on a display cell in which a sustain discharge is not intended, without carrying out the address discharge. The method of driving the plasma display panel may further comprise the steps of applying a voltage pulse, having the same polarity as a voltage pulse for carrying out the address discharge between the first electrodes and the second electrodes and having a voltage waveform that finally becomes more than the voltage between the first electrodes and the second electrodes in the time of addressing; and carrying out a further auxiliary discharge to decrease the volume of wall charges, accumulated on a display cell in which a sustain discharge is not intended, without carrying out the address discharge. The voltage waveform applied between the first electrodes and the second electrodes when carrying out the further auxiliary discharge may be a voltage waveform having a less steep inclination.

The second electrodes may be oppositely driven into an odd electrode group and an even electrode group in temporal and, after finishing an address period of one of the odd and even electrode groups, and the method of driving the plasma display panel may further comprise the steps of applying a voltage pulse, having the same polarity as a voltage pulse for carrying out the address discharge on the second electrodes and having the same or a higher voltage than that of a scan pulse; and carrying out a further auxiliary discharge to decrease the volume of wall charges, accumulated on a display cell in which a sustain discharge is not intended, without carrying out the address discharge.

The voltage applied between the second electrodes and the first electrodes constituting a display line when carrying out the further auxiliary discharge may be equivalent to a voltage applied to the second electrodes for carrying out the auxiliary discharge.

According to the present invention, there is also provided a method of driving a plasma display panel having a plurality of first electrodes, a plurality of second electrodes disposed adjacently and alternately, and a plurality of third electrodes formed to cross the first and second electrodes, wherein the second electrodes are oppositely driven into an odd electrode group and an even electrode group in temporal; and after finishing an address period of one of the odd and even electrode groups, a voltage of any of the second electrodes finishing an address process is set lower than a non-selection voltage of the second electrode when carrying out the address process.

Further, according to the present invention, there is provided a method of driving a plasma display panel having a plurality of first electrodes, a plurality of second electrodes adjacently disposed alternately, and a plurality of third electrodes formed to cross the first and second electrodes, wherein the first electrodes and the second electrodes are divided into an odd electrode group and an even electrode group, and each adjacent odd electrode of the odd electrode group and each adjacent even electrode of the even electrode group or each adjacent odd and even electrode constitutes a display line; a plurality of discharges of an initial stage of a sustain discharge period are oppositely carried out by each adjacent odd electrode or each adjacent even electrode; and one or both voltages of the first electrodes and the second electrode, where the sustain discharge is not carried out, are set low.

A voltage applied to an electrode not carrying out a discharge may be set low by bringing a driving circuit for the electrode to a high impedance state.

According to the present invention, there is also provided a method of driving a plasma display panel having a plurality of first electrodes, a plurality of second electrodes disposed adjacently and alternately, and a plurality of third electrodes formed to cross the first and second electrodes, comprising the steps of carrying out an address discharge between the second electrodes and the third electrodes; carrying out a sustain discharge by alternately applying sustain pulses to the first and second electrodes; and carrying out an auxiliary discharge on a scale larger than the scale of the sustain discharge carried out immediately before.

The method of driving the plasma display panel may further comprise the steps of generating a discharge in a selected cell by applying a voltage pulse with the third electrodes set to have a first polarity and the second electrodes set to have a second polarity; forming wall charges of a first polarity on at least the second electrodes, with the first electrodes set to have a first polarity with respect to the second electrodes, and also forming wall charges of a second polarity on the first electrodes; and applying a voltage pulse to the third or second electrodes or to both electrodes so as to set the third electrodes to have a first polarity and to set the second electrodes to have a second polarity.

A voltage to be applied to the third electrodes when carrying out the auxiliary discharge may be equivalent to a voltage of a voltage pulse to be applied to the third electrodes in order to execute an address discharge during an address period. A voltage to be applied to the third electrodes when carrying out the auxiliary discharge may have a polarity opposite to the polarity of the potentials of the second and third electrodes during a sustain discharge period. A voltage to be applied to the second electrodes when carrying out the auxiliary discharge may be equivalent to a voltage selectively applied to the second electrodes at the time of carrying out an address discharge.

A voltage to be applied to the first electrodes when carrying out the auxiliary discharge may be a voltage having a polarity opposite to the polarity of the second electrodes. The voltage to be applied to the first electrodes when carrying out the auxiliary discharge may be equivalent to a voltage to be applied to the first electrodes at the time of carrying out an address discharge. The auxiliary discharge may be carried out once in a plurality of sub-fields. The auxiliary discharge may be carried out once in one frame or once in one field. The first electrodes and the second electrodes may be disposed alternately and in parallel, and the third electrodes may be orthogonal to the first and second electrodes.

Further, according to the present invention, there is provided a method of driving a plasma display panel having a plurality of first electrodes, a plurality of second electrodes disposed adjacently and alternately, and a plurality of third electrodes formed to cross the first and second electrodes, for applying, at a reset time, an erasing pulse having a less steep inclination (having a long rising or falling edge) with respect to the second electrodes to which a scan pulse is applied, comprising the step of rapidly changing a pulse voltage (having a rising or falling edge sufficiently shorter than that of the erasing pulse) until the pulse voltage becomes equivalent to a voltage of the scan pulse, at an end stage of the erasing pulse.

According to the present invention, there is also provided a plasma display panel comprising a plurality of first electrodes; a plurality of second electrodes disposed adjacently and alternately to the first electrodes; a plurality of third electrodes formed to cross the first and second electrodes; and a control circuit for carrying out an address discharge between the second electrodes and the third electrodes, wherein the control circuit carries out a sustain discharge to decrease the volume of wall charges, accumulated on a display cell in which a sustain discharge is not intended, to a level which cannot generate a sustain discharge.

According to the present invention, there is also provided a method of driving a plasma display panel having a plurality of first electrodes, a plurality of second electrodes adjacently disposed alternately, and a plurality of third electrodes formed to cross the first and second electrodes, comprising the steps of carrying out an address discharge between the second electrodes and the third electrodes; and carrying out a sustain discharge by alternately applying sustain pulses to the first and second electrodes, wherein an auxiliary discharge is carried out, between the first electrodes and the third electrodes, during the address discharge and the sustain discharge.

In addition, according to the present invention, there is provided a plasma display panel comprising a plurality of first electrodes; a plurality of second electrodes disposed adjacently and alternately to the first electrodes; a plurality of third electrodes formed to cross the first and second electrodes; and a control circuit for carrying out an address discharge between the second electrodes and the third electrodes, wherein the control circuit carries out an auxiliary discharge on a scale larger than the scale of a sustain discharge carried out immediately before.

The first electrodes and the second electrodes may be disposed alternately in parallel, and the third electrodes may be orthogonal with the first and second electrodes.

BRIEF DESCRIPTION OF THE DRAWINGS

The present invention will be more clearly understood from the description of the preferred embodiments as set forth below with reference to the accompanying drawings, wherein.

DETAILED DESCRIPTION OF THE PREFERRED EMBODIMENTS

Before a detailed description of the present invention is provided, a conventional plasma display panel, a conventional method of driving the plasma display panel, and problems in the conventional techniques will be explained, with reference to the drawings.

Figure 1A:
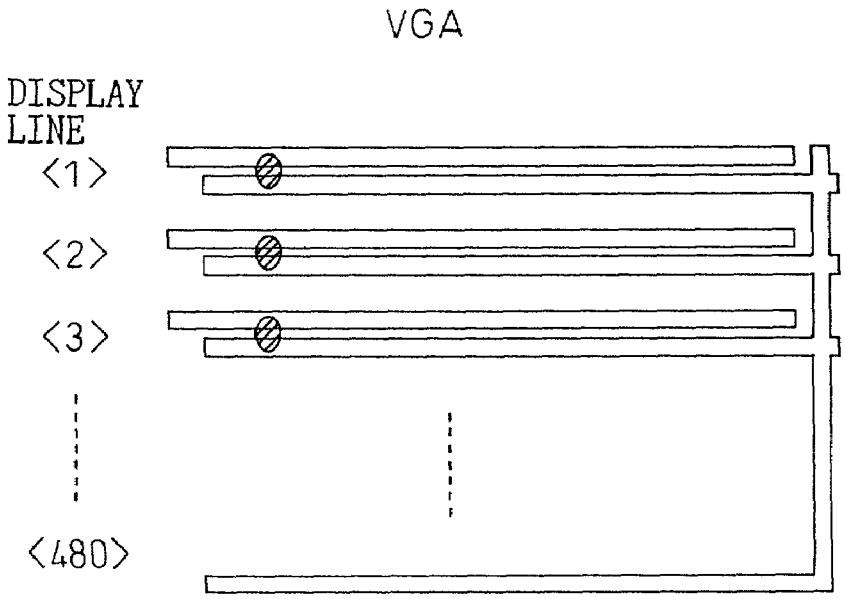
FIG. 1A and FIG. 1B are diagrams showing a comparison between a plasma display panel (PDP) of the ALIS system to which the present invention is applied and a conventional plasma display panel.
Figure 1B:
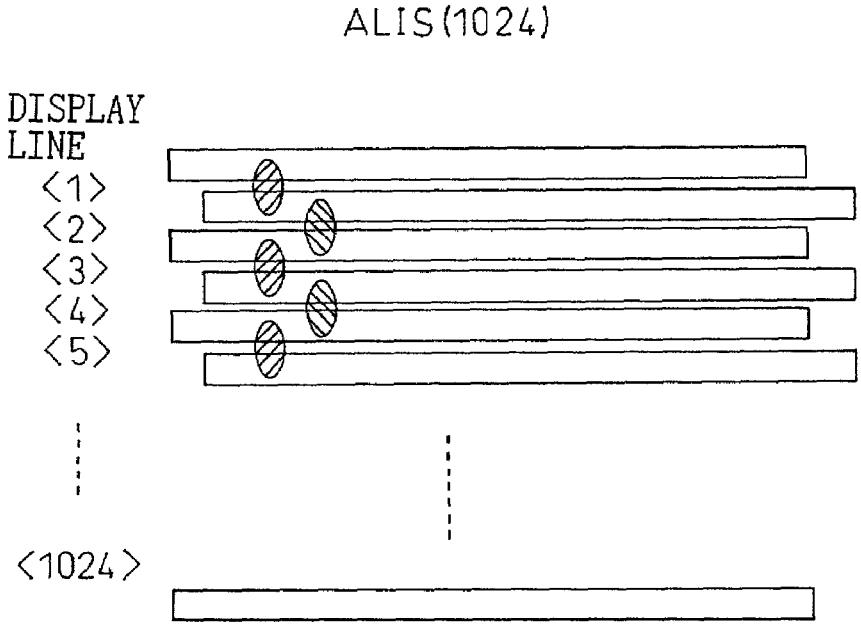

FIG. 1A and FIG. 1B are diagrams showing a comparison between a plasma display panel (PDP) of the ALIS system to which the present invention is applied and a conventional plasma display panel. FIG. 1A shows a conventional PDP (for example, VGA: having 480 display lines), and FIG. 1B shows a PDP of the ALIS system (for example, having 1,024 display lines).

As shown in FIG. 1A, the conventional PDP has two display electrodes disposed in parallel. In order to carry out a display discharge between these electrodes, it is necessary to provide display electrodes (also called a sustain electrode) having two times the number of display lines. For example, in the case of a VGA having 480 display lines, 480×2=960 display electrodes have been necessary.

On the other hand, in the case of the PDP of the ALIS system, a display is carried out by generating a discharge between all the adjacent electrodes as disclosed in, for example, Japanese Patent No. 2801893 (Japanese Unexamined Patent Publication (Kokai) No. 09-160525: corresponding to EP 0762373-A2), and as shown in FIG. 1B. According to this system, a required number of display electrodes is the number of display lines plus one. For example, when there are 1,024 display lines, the required number of electrodes is 1,024+1=1,025.

In other words, according to the PDP of the ALIS system, it is possible to achieve a high definition of two times that achieved by the conventional system, by using a number of electrodes equivalent to that of the conventional system. Further, according to the PDP of the ALIS system, it is possible to minimize the shielding of light beams due to electrodes, based on an efficient use of discharging space without a waste. As a result, a high aperture ratio can be obtained, and a high brightness can be realized.

Figure 2:
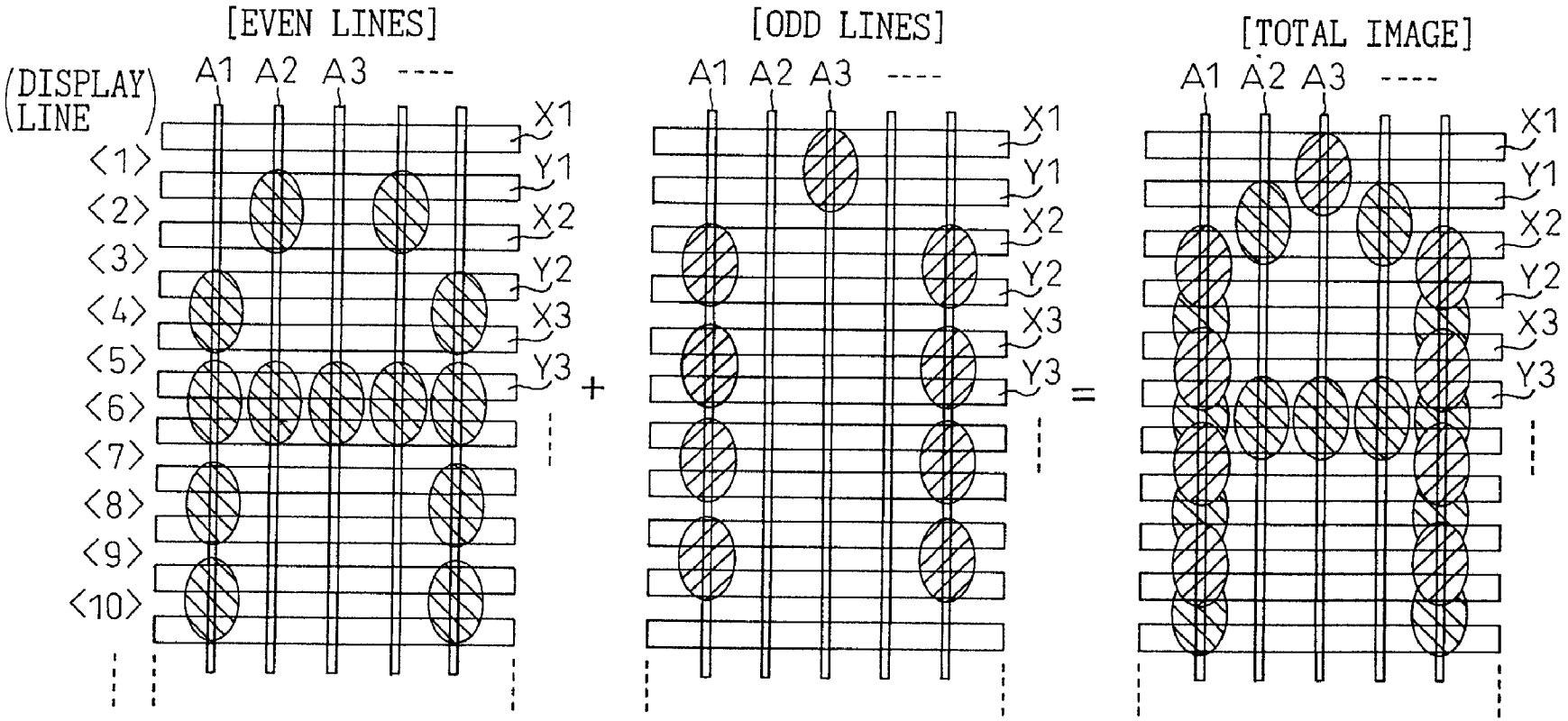
FIG. 2 is a diagram for explaining a method of displaying a PDP of the ALIS system.

FIG. 2 is a diagram for explaining a method of driving a PDP of the ALIS system. This shows an example of displaying a character "A". In FIG. 2, X-electrodes X1, X2, - - - , and Y-electrodes Y1, Y2, - - - are display electrodes (sustain electrodes). A1, A2, - - - are address electrodes.

As shown in FIG. 2, according to the display method of the ALIS system, the display of an image is divided into odd lines and even lines in time order. For example, a display is made on odd lines (display lines <1>, <3>, <5>, - - - ) based on the discharge between the X-electrodes (X1, X2, - - - ) and the Y-electrodes (Y1, Y2, - - - ) below these X-electrodes. Also, a display is made on even lines (display lines <2>, <4>, <6>, - - - ) based on the discharge between the Y-electrodes (Y1, Y2, - - - ) and the X-electrodes (X2, X3, - - - ) below these Y-electrodes. These two sets of displays are combined together to make a display of a whole image (total image). This display method is very similar to that of an interlace scanning of a picture tube.

Figure 3A:
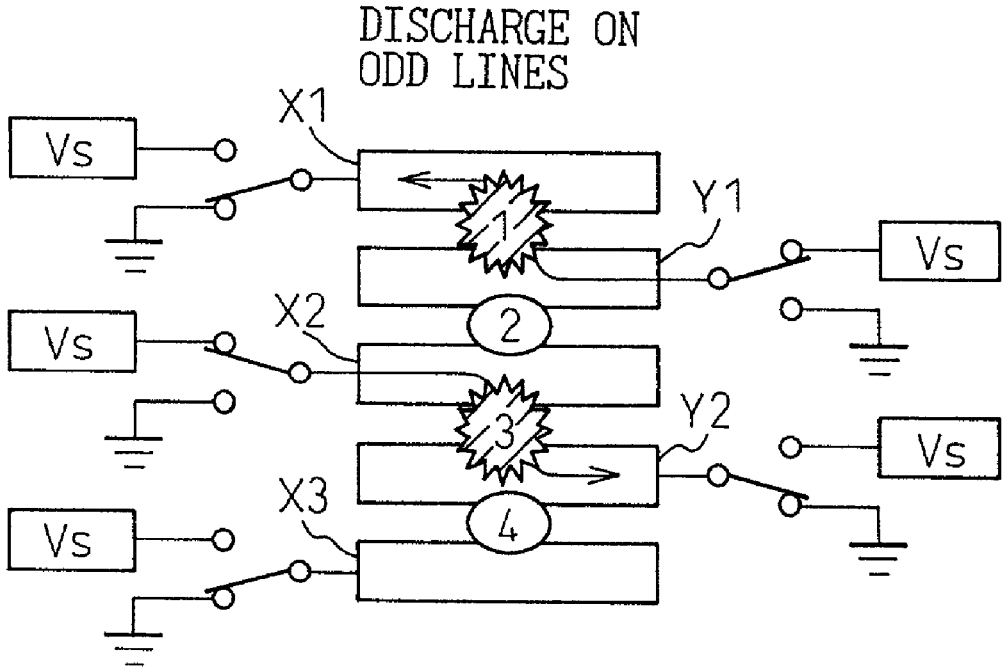
FIG. 3A and FIG. 3B are diagrams for explaining the operation principle of a PDP of the ALIS system.
Figure 3B:
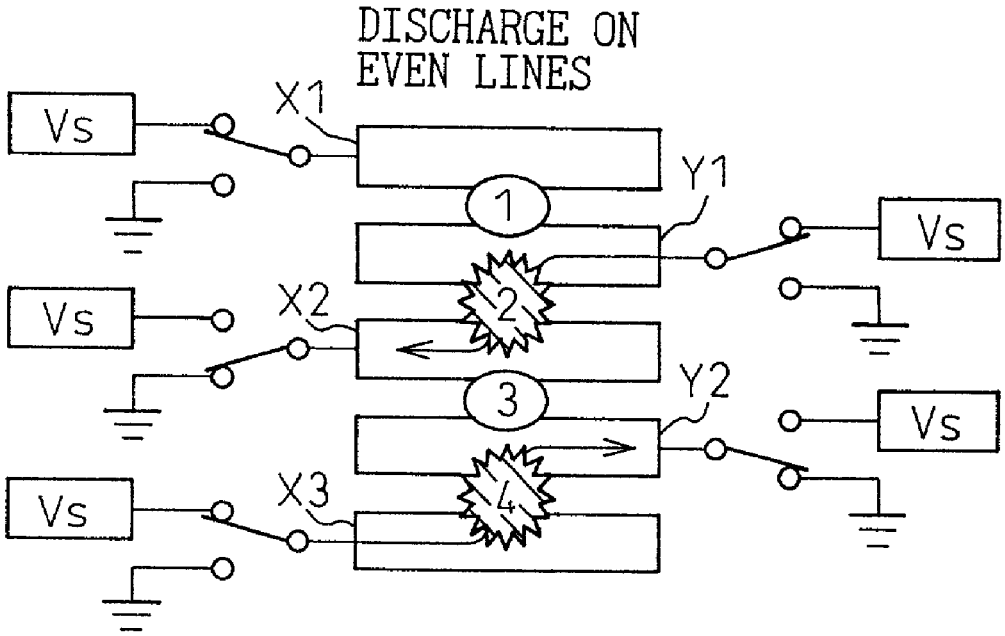

FIG. 3A and FIG. 3B are diagrams for explaining the operation principle of a PDP of the ALIS system. FIG. 3A shows the operation during a discharge (display) of the odd lines, and FIG. 3B shows the operation during a discharge (display) of the even lines.

As shown in FIG. 3A, in order to make a stable discharge on the odd display lines (display lines <1>, <3>, - - - ), for example, the odd X-electrodes X1, X3, - - - are grounded (for example, zero volt), a voltage Vs is applied to the odd Y-electrodes Y1, Y3, - - - , a voltage Vs is applied to the even X-electrodes X2, X4, - - - , and the even Y-electrodes Y2, Y4, - - - are grounded. Based on this arrangement, a current is discharged to the odd display lines <1>, <3>, - - - , and a current is not discharged to the even lines <2>, <4>, - - - . In other words, a current is discharged to the first display line <1>based on a voltage (Vs) generated between the grounded first X-electrode X1 and the first Y-electrode Y1 to which the voltage Vs has been applied. Further, a current is discharged to the third display line <3> based on a voltage (Vs) generated between the second X-electrode X2 to which the voltage Vs has been applied and the grounded second Y-electrode Y2. In this case, a current is not discharged to the second display line <2> as there occurs no potential difference between the first Y-electrode Y1 to which the voltage Vs has been applied and the second X-electrode X2 to which the voltage Vs has been applied. Further, a current is not discharged to the fourth display line <4> as there occurs no potential difference between the grounded second Y-electrode Y2 and the grounded third X-electrode X3.

On the other hand, as shown in FIG. 3B, in order to make a stable discharge on the even display lines (display lines <2>, <4>, - - - ), for example, a voltage vs is applied to the odd X-electrodes X1, X3, - - - and to the odd Y-electrodes Y1, Y3, - - - , and the even X-electrodes X2, X4, - - - , and the even Y-electrodes Y2, Y4, - - - are grounded. Based on this arrangement, a current is discharged to the even display lines <2>, <4>, - - - , and a current is not discharged to the odd lines <1>, <3>, In other words, a current is discharged to the second display line <2> based on a voltage (Vs) generated between the first Y-electrode Y1 to which the voltage Vs has been applied and the grounded second X-electrode X2. Further, a current is discharged to the fourth display line <4> based on a voltage (Vs) generated between the grounded second Y-electrode Y2 and the third X-electrode X3 to which the voltage Vs has been applied. In this case, a current is not discharged to the first display line <1> as there occurs no potential difference between the first X-electrode X1 to which the voltage Vs has been applied and the first Y-electrode Y1 to which the voltage Vs has been applied. Further, a current is not discharged to the third display line <3> as no potential difference occurs between the grounded second X-electrode X2 and the grounded second Y-electrode Y2.

By alternately repeating the discharge on the odd lines shown in FIG. 3A and the discharge on the even lines shown in FIG. 3B, the discharge of the odd lines and the discharge of the even lines are combined together. As a result, a total image is displayed.

Figure 4:
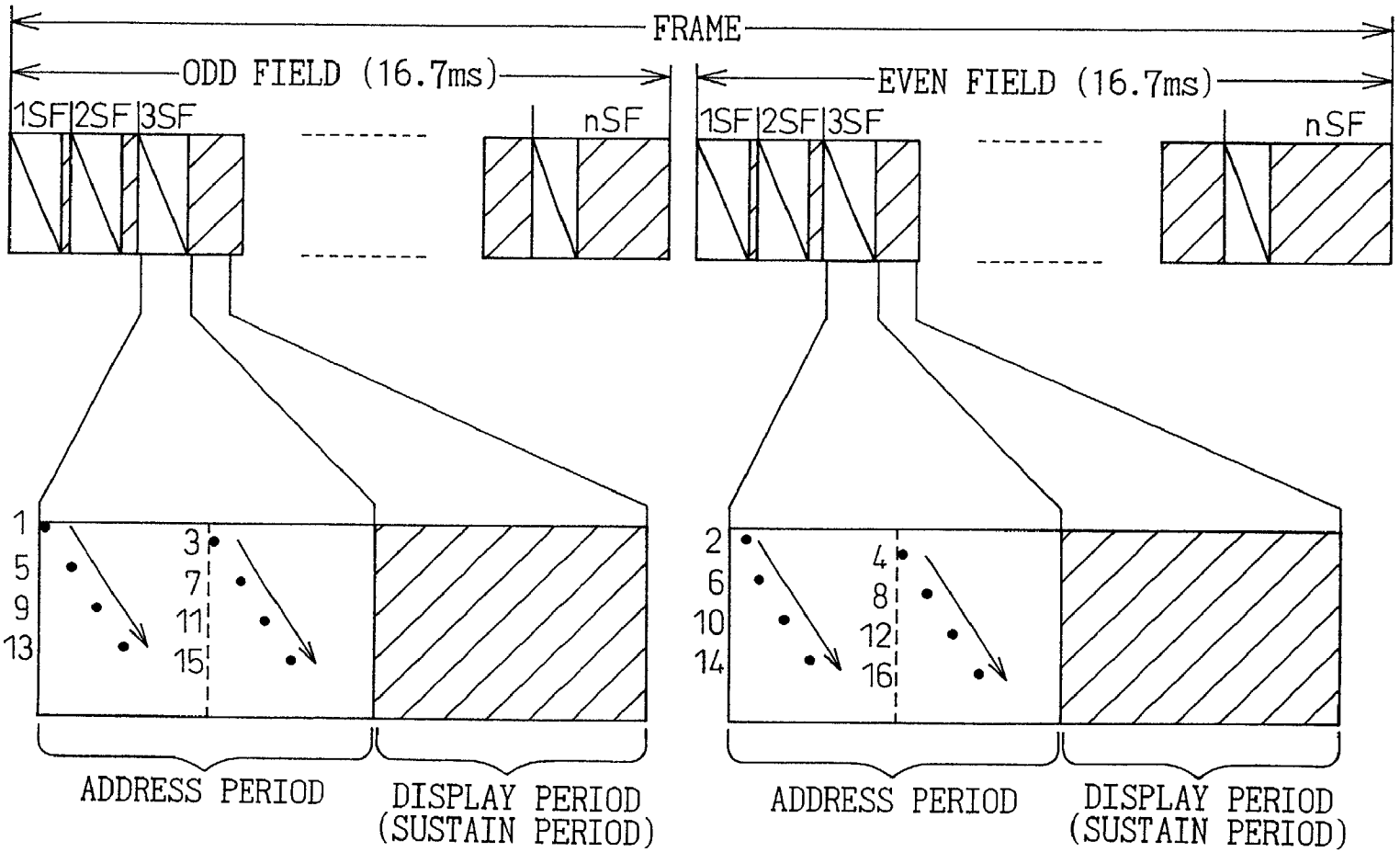
FIG. 4 is a diagram showing one example of a display sequence of a PDP of the ALIS system.

FIG. 4 is a diagram showing one example of a display sequence of a PDP of the ALIS system.

As explained above, according to the PDP of the ALIS system, a display of a total screen is carried out by dividing the display into a display (discharge) of the odd lines and a display of the even lines. Therefore, one frame is divided into an odd field and an even field as shown in FIG. 4. Each of these odd and even fields is further divided into a plurality of sub-fields (1SF to nSF). It is necessary to divide each field into the plurality of sub-fields in order to carry out a gradation display. Usually, in order to realize a graduation of about 50 to 300, each field is divided into about eight to twelve sub-fields (SF).

Each sub-field (4SF to nSF) is further divided into a reset period (not shown in FIG. 4: positioned before an address period) for initializing a state of the discharge cell, an address period for writing into a lighting cell according to a display data, and a display period (a sustain period) for making a display using a cell selected during the address period. During the display period, a discharge is carried out repeatedly (a sustain discharge). The weight of the brightness of each sub-field is determined based on the number of this repetition.

Figure 5:
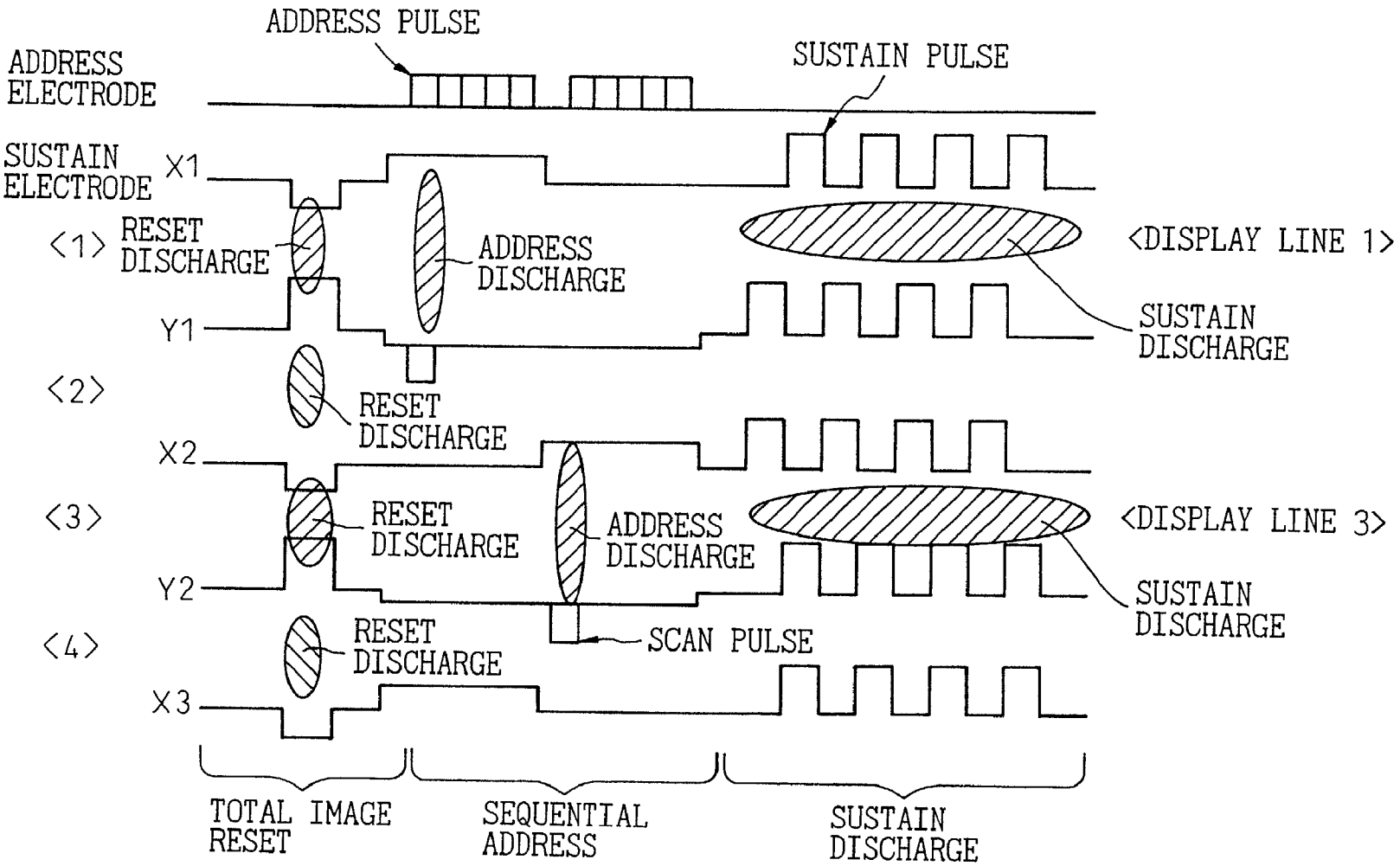
FIG. 5 is a diagram (an odd field) showing one example of a driving waveform according to the ALIS system.
Figure 6:
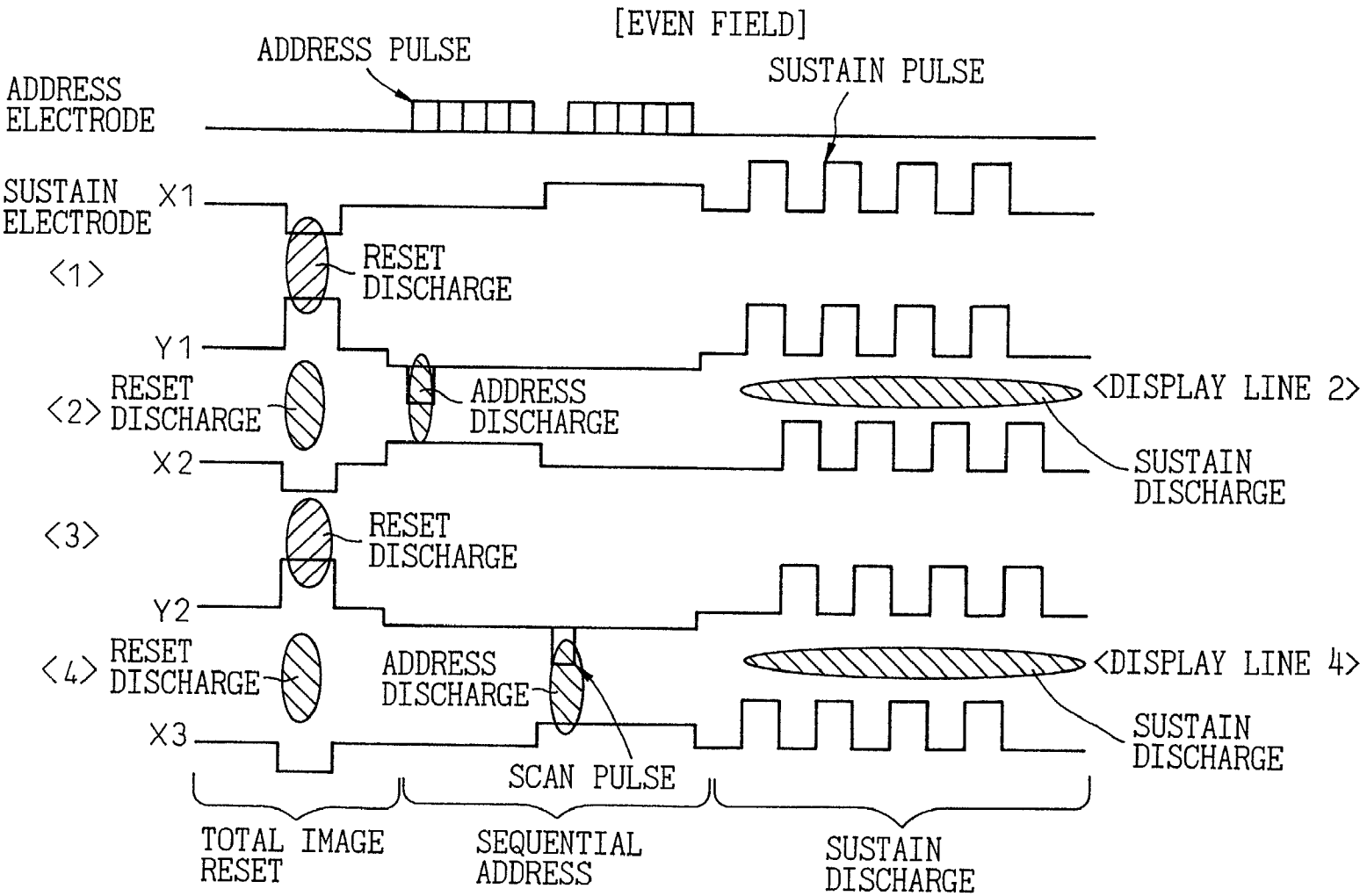
FIG. 6 is a diagram (an even field) showing one example of a driving waveform according to the ALIS system.

FIG. 5 is a diagram (part 1: an odd field) showing one example of a driving waveform according to the ALIS system, and FIG. 6 is a diagram (part 2: an even field) showing one example of a driving waveform according to the ALIS system. Each drawing shows a driving waveform of one sub-field.

As shown in FIG. 5, in the driving waveform of one sub-field in the odd field, a voltage pulse is applied to between all the adjacent X-electrodes X1, x2, - - - - and Y-electrodes Y1, Y2, - - - , thereby to carry out an initial discharge (a reset discharge), during the reset period. During the address period, a selective pulse (a scan pulse) is sequentially applied to the Y-electrodes Y1, Y2, - - - , and an address pulse is applied to the address electrode (A1, A2, - - - ) corresponding to a selected cell, thereby executing a write discharge (an address discharge). After executing the reset discharge and the write discharge to the whole screen, a sustain pulse is applied alternately to the X-electrodes and the Y-electrodes, thereby executing a sustain discharge (a sustain discharge). FIG. 5 shows a driving waveform of the odd field for carrying out a display of the odd lines (odd display lines <1>, <3>, - - - ). In FIG. 5, the address discharge and the sustain discharge are generated for only the odd display lines.

FIG. 6 shows a driving waveform of the even field for displaying the even lines (the even display lines <2>, <4>, - - - ). This corresponds to the driving waveform in the odd field shown in FIG. 5. In FIG. 6, the address discharge and the sustain discharge are generated for only the even display lines.

Figure 7:
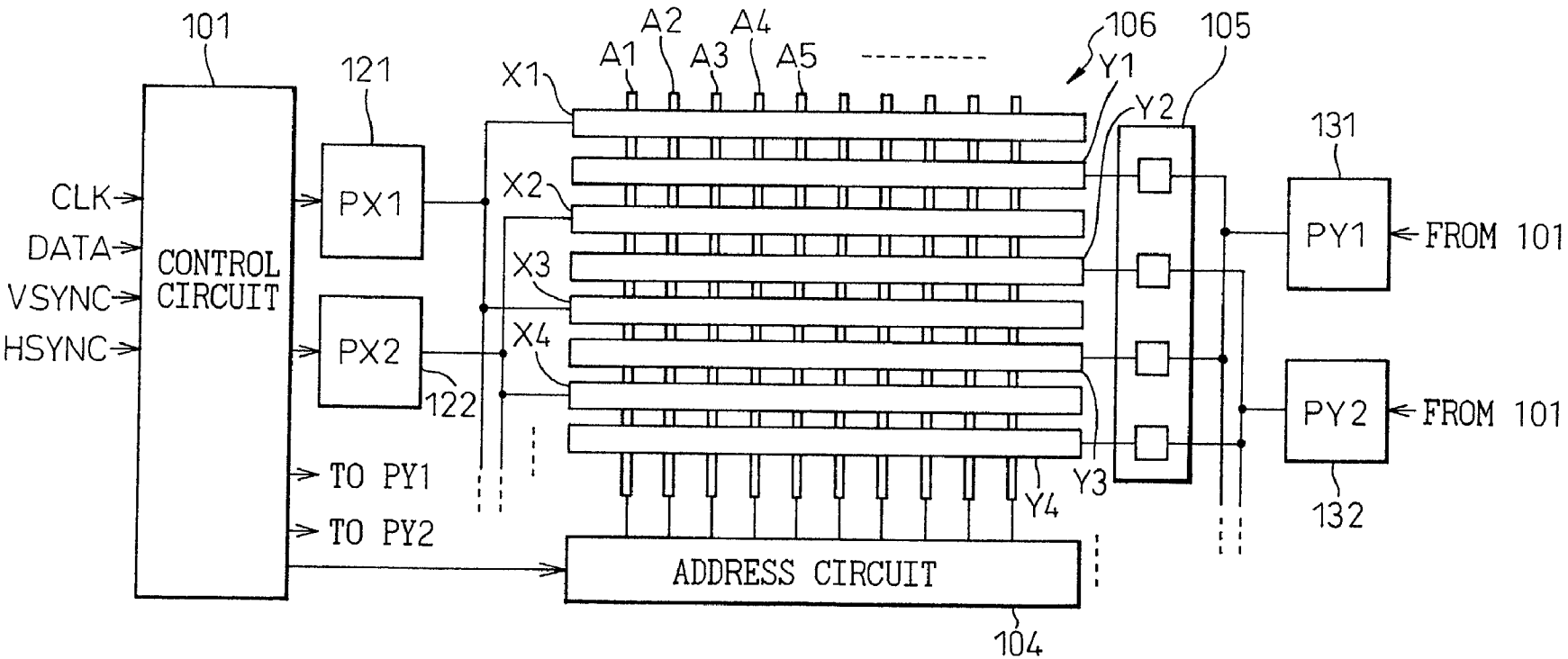
FIG. 7 is a circuit block diagram showing one example of a PDP of the ALIS system to which the present invention is applied.

FIG. 7 is a circuit block diagram showing one example of a PDP (a PDP apparatus) of the ALIS system to which the present invention is applied. In FIG. 7, a reference symbol 101 denotes a control circuit, 121 denotes a sustain circuit for odd X-electrodes (PX1), 122 denotes a sustain circuit for even X-electrodes (PX2), 131 denotes a sustain circuit for odd Y-electrodes (PY1), 132 denotes a sustain circuit for even Y-electrodes (PY2), 104 denotes an address circuit (an address driver), 105 denotes a scanning circuit (a scan driver), and 106 denotes a display panel (PDP).

The control circuit 101 converts display data DATA supplied from the outside into data for the display panel 106, and supplies the converted data to the address circuit 104. The control circuit 101 further generates various control signals according to a clock CLK, a vertical synchronization signal VSYNC, and a horizontal synchronization signal HSYNC, and controls the circuits 121, 122, 131, 132, 104, and 105. In order to apply the voltage waveforms shown in FIG. 5 and FIG. 6 to the electrodes, a power source (not shown) supplies predetermined voltages to the sustain circuit for odd X-electrodes 121, the sustain circuit for even X-electrodes 122, the sustain circuit for odd Y-electrodes 131, the sustain circuit for even Y-electrodes 132, the address circuit 104, and the scanning circuit 105, respectively.

Figure 8:
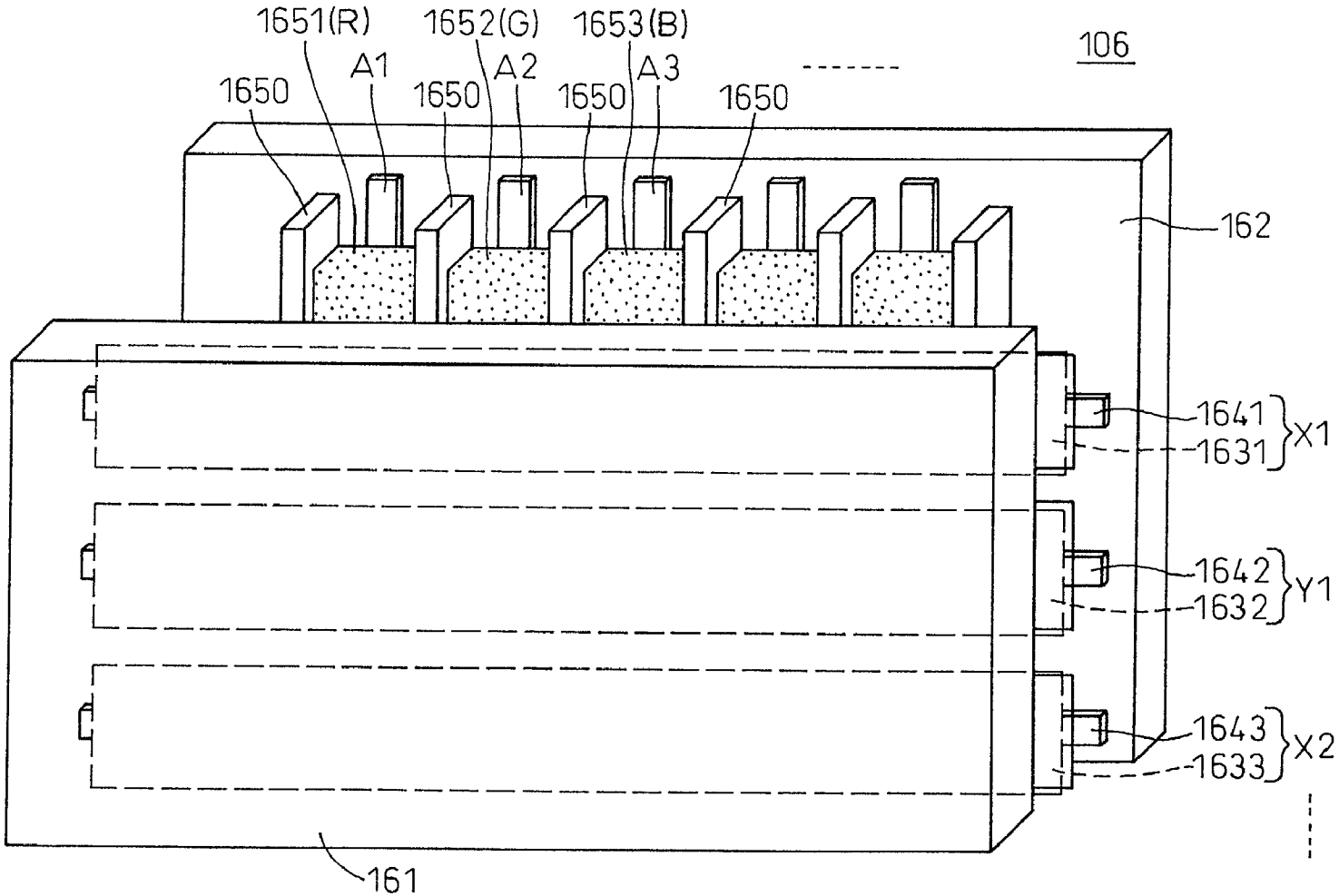
FIG. 8 is a diagram showing one example of a panel structure of a PDP of the ALIS system.

FIG. 8 is a diagram showing one example of a panel structure of a PDP of the ALIS system. The display panel 106 includes a color type and a monochromatic type. FIG. 8 shows a case of the color display panel.

As shown in FIG. 8, on a front glass substrate 161, there are alternately formed in parallel the X-electrodes and Y-electrodes X1, Y1, X2, - - - that are structured by transparent electrodes like ITO films 1631, 1632, 1633, - - - and metal electrodes like copper electrodes 1641, 1642, 1643, - - - . In this case, in the X-electrode X1, for example, the metal electrode 1641 is provided along a longitudinal direction of its transparent electrode 1631 in order to decrease a reduction in the voltage due to the transparent electrode 1631. A dielectric for holding a wall charge and a protection film like an MgO film (not shown) is provided over the whole surface of the transparent electrodes 1631, 1632, 1633, - - - and the metal electrodes 1641, 1642, 1643, - - - that constitute the X-electrodes and Y-electrodes X1, Y1, X2, - - - , and over the whole inner surface of the front glass substrate 161.

On a rear glass substrate 162, there are formed the address electrodes A1, A2, A3, - - - and partitions 1650 surrounding these address electrodes, in a direction orthogonal with the X-electrodes and the Y-electrodes X1, Y1, X2, - - - , on the surface opposite to the MgO protection film of the front glass substrate 161. Phosphors 1651, 1652, 1653, - - - that emit various colors (a red color R, a green color G, and a blue color B) based on an incidence of ultraviolet rays generated by a discharge are coated on the address electrodes A1, A2, A3, - - - that are surrounded by the partitions 1650. A Penning mixed gas of Ne+Xe is sealed into a discharge space formed between the MgO protection film (the inner surface) of the front glass substrate 161 and the phosphors (the inner surface) of the rear glass substrate 162.

The odd X-electrodes X1 (X3, X5, - - - ) of the front glass substrate 161 are connected to the sustain circuit for odd X-electrodes 121 shown in FIG. 7, and the even X-electrodes X2 (X4, X6, - - - ) are connected to the sustain circuit for even X-electrodes 122. The odd Y-electrodes Y1 (Y3, Y5, - - - ) are connected to the sustain circuit for odd Y-electrodes 131 via the scanning circuit 105 (the IC for scan driving) 105, and the even Y-electrodes Y2 (Y4, Y6, - - - ) are connected to the sustain circuit for even Y-electrodes 132 via the scanning circuit 105. Based on this arrangement, the above-described driving of the ALIS system is carried out.

Figure 9:
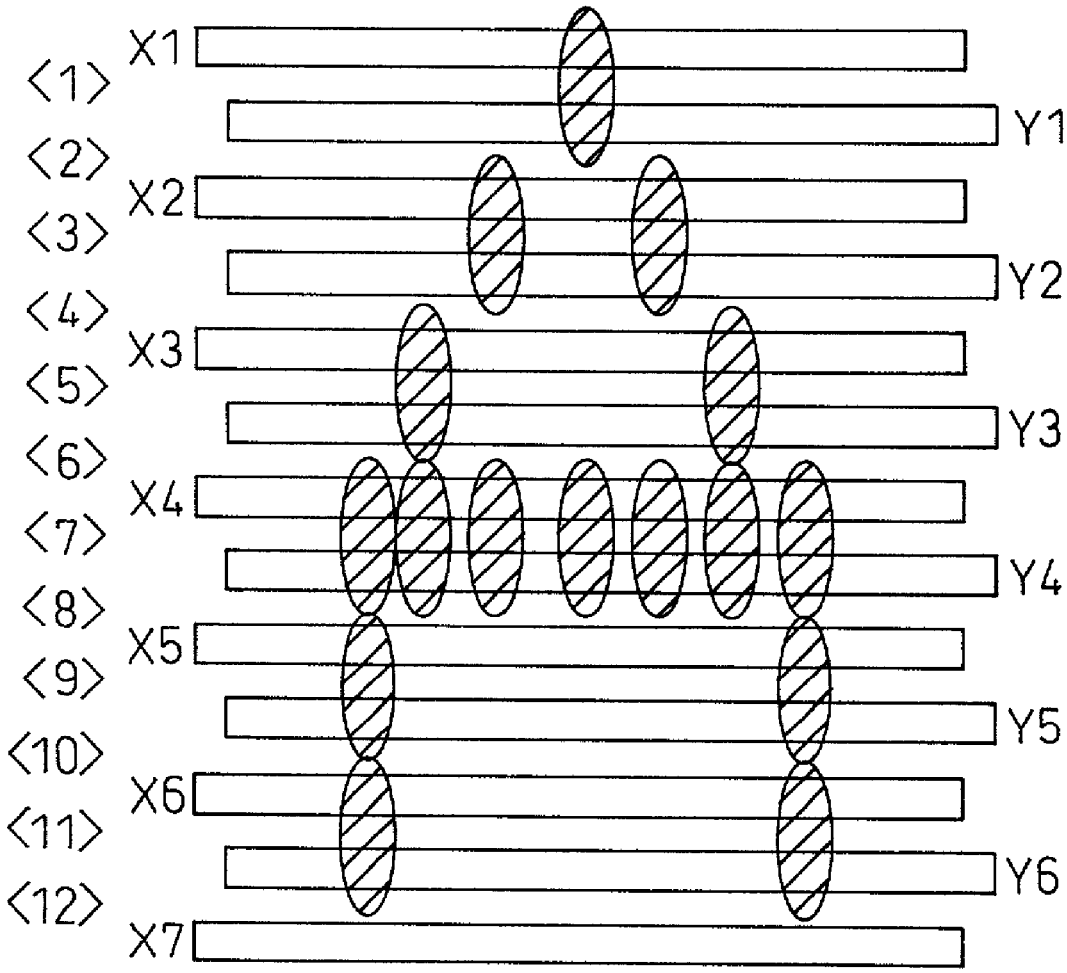
FIG. 9 is a diagram showing a state of carrying out a fixed display based on a single field (odd field)
Figure 10:
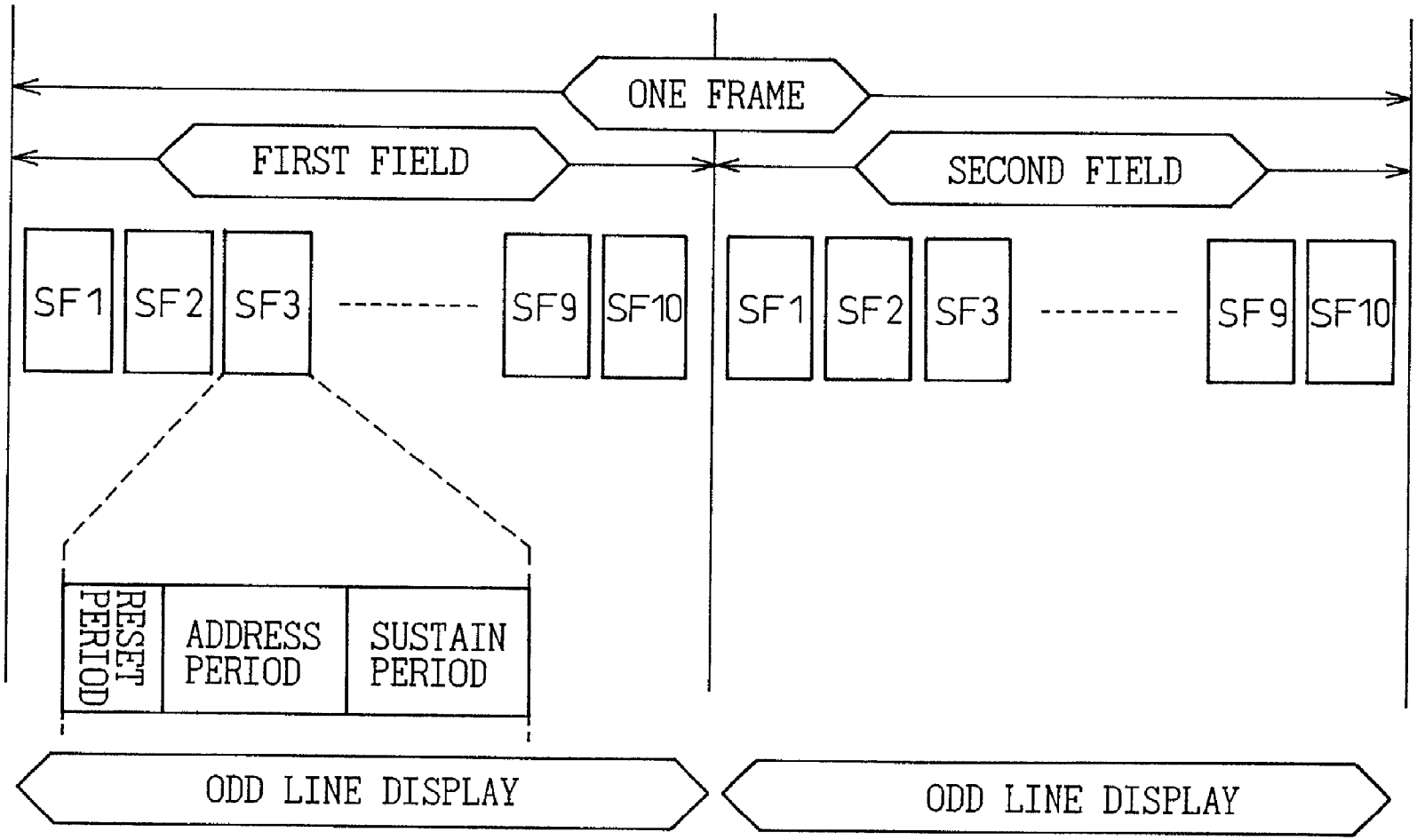
FIG. 10 is a diagram showing one example of a lighting sequence of a fixed display based on only the single field shown in FIG. 9.

FIG. 9 is a diagram showing a state of carrying out a fixed display based on a single field (the odd field), and FIG. 10 is a diagram showing one example of a lighting sequence of a fixed display based on only the single field shown in FIG. 9.

As explained previously, the PDP of the ALIS system operates by lighting the odd lines and the even lines by separate fields as shown in FIG. 4. As the display sequence in the PDP of the ALIS system has a display state similar to that of the interlace display, a flickering of 30 Hz, for example, occurs in the lighting of one line. Usually, this flickering is not so serious a problem in the case of a video display like that on a picture tube. However, when the PDP is used for a display of information like characters, it is preferable that there is no flickering. When the PDP is used for this purpose, the lines used for carrying out a display are fixed. In other words, a display is carried out by always repeating the odd field or the even field.

More specifically, in the PDP of the ALIS system, when there is a request for avoiding a flickering at the cost of a reduction in the resolution to a half in the display of information like characters, only one field, for example, the odd field, is repeatedly used to carry out a display as shown in FIG. 10. In this case, the number of lines that can be used for making a display is decreased to a half of the total lines, as is apparent from FIG. 9.

FIGS. 11 to 15B are diagrams for explaining the problem of a fixed display in a PDP of the ALIS system. In FIGS. 11 to 15B, a reference symbol 161 denotes a front glass substrate, and 162 denotes a rear glass substrate.

Figure 11:
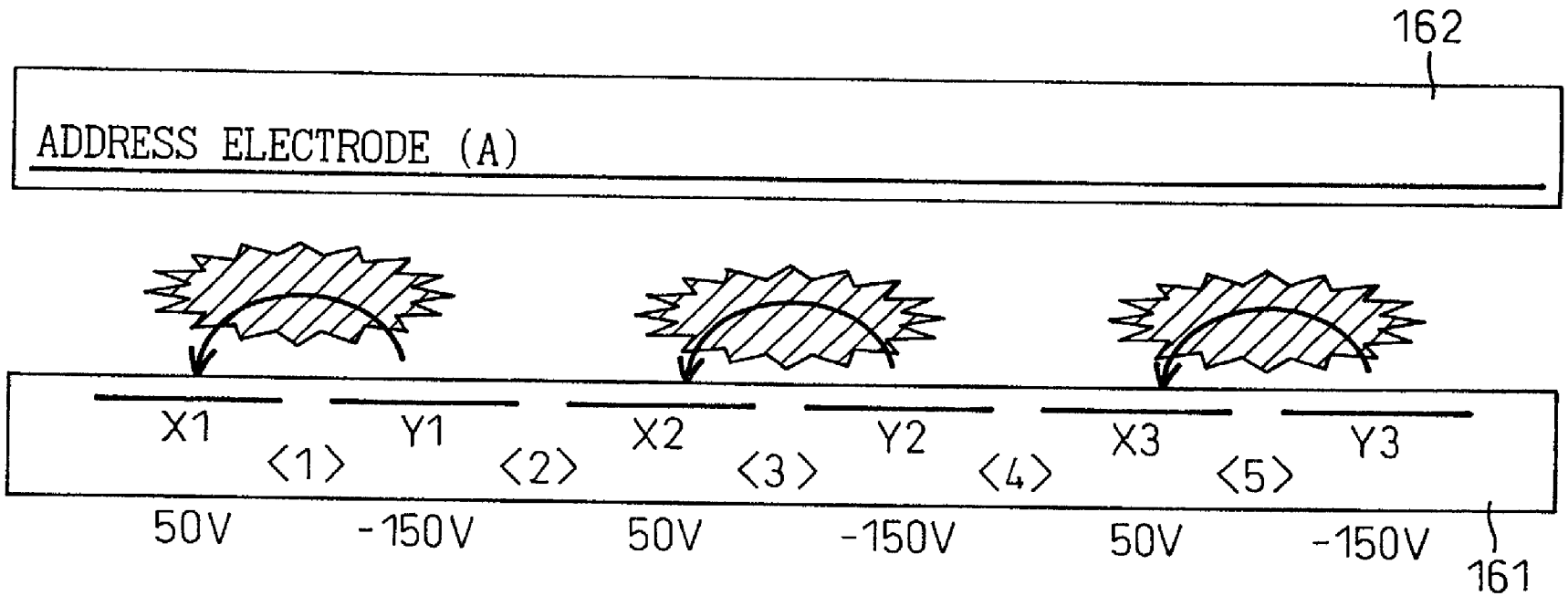
FIG. 11 is a diagram (part 1) for explaining a problem of a fixed display in a PDP of the ALIS system.

As described above, in the PDP of the ALIS system, when only one field, for example the odd field, is used to carry out a display of information like characters, for example, the address discharge is always in the same direction as shown in FIG. 11. When this driving (display) is repeated, a distortion in the electric charge occurs on the display panel as shown in FIG. 12A.

FIG. 11 shows a state of an address discharge. During the address discharge period, a discharge occurs between the X-electrodes and the Y-electrodes on the front glass substrate by triggering a discharge between the address electrode (A) provided on the rear glass substrate 162 and the Y-electrodes provided on the front glass substrate 161. In this case, a pulse of about 50 to 80 V is applied to the address electrodes according to the display data, and a scan pulse of about −150 V to −200 V is applied the Y-electrodes. With this arrangement, a voltage between the address electrodes and the Y-electrodes exceeds a discharge starting voltage, and the discharge starts. When a voltage of about 50 to 100 V has been applied in advance to the X-electrodes, the discharge generated between the address electrodes and the Y-electrodes extends to between the X-electrodes and the Y-electrodes. This discharge converges based on the accumulation of the wall charge. Electrons and ions generated by the discharge move based on the electric field within the discharge space. The electrons move to the X-electrodes side as an anode, and the ions move to the Y-electrodes side as a cathode. In the sustain discharge after the address discharge, a discharge is carried out even in the opposite polarity. However, the sustain discharge is carried out at a voltage of about 150 to 180 V which is lower than a potential difference of about 200 V between the X-electrodes and the Y-electrodes during the address period. Thus, a charge moved during the address period cannot be completely recovered.

Figure 12A:
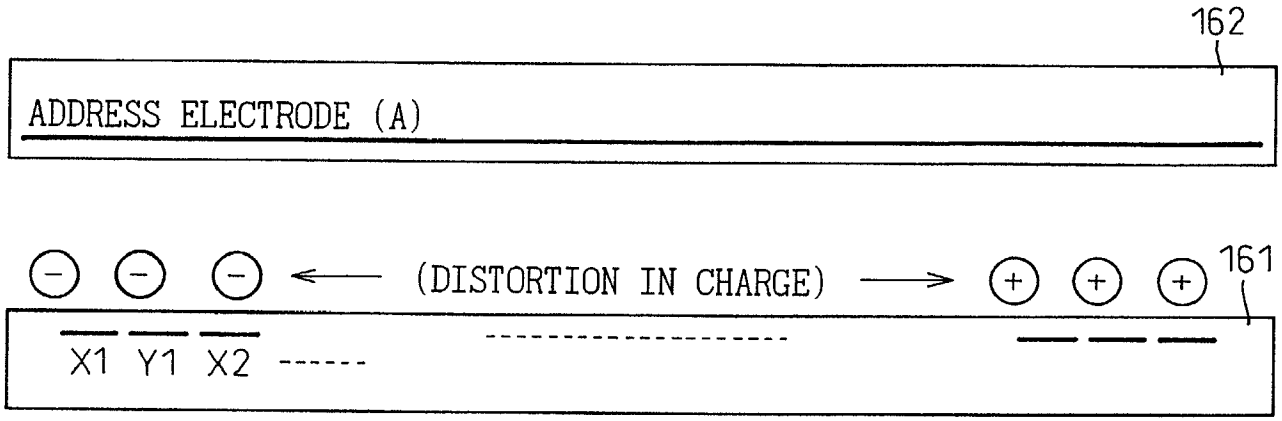
FIG. 12A and FIG. 12B are diagrams (part 2) for explaining a problem of a fixed display in a PDP of the ALIS system.

By repeating the above operation, the electrons move to the left side (the upper side of the display panel) in FIG. 12A, for example. The ions are in a surplus state in the right side (the lower side of the display panel) from which the electrons have been removed. While details of this phenomenon have not yet been made clear, this state is considered to occur due to the larger mobility of the electrons compared to that of the ions.

Figure 12B:
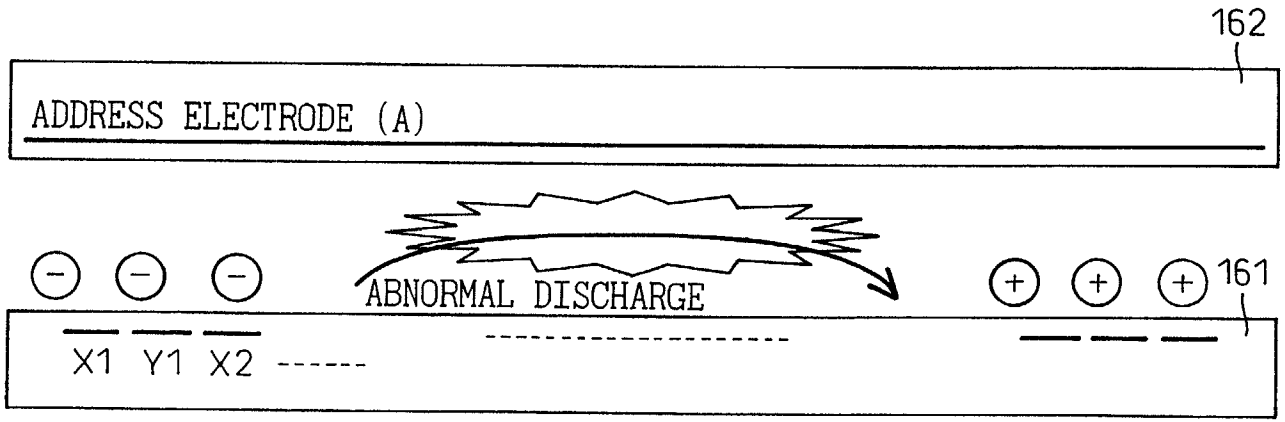

When the accumulated charge becomes larger than a certain level after repeating this display operation, a large-scale abnormal discharge may occur over a substantially long distance exceeding the distance between the pairs of the X-electrodes and the Y-electrodes as shown in FIG. 12B. This abnormal discharge can prevent a normal operation thereafter, and can damage the circuit by breaking an insulation film with a large voltage.

Figure 13:
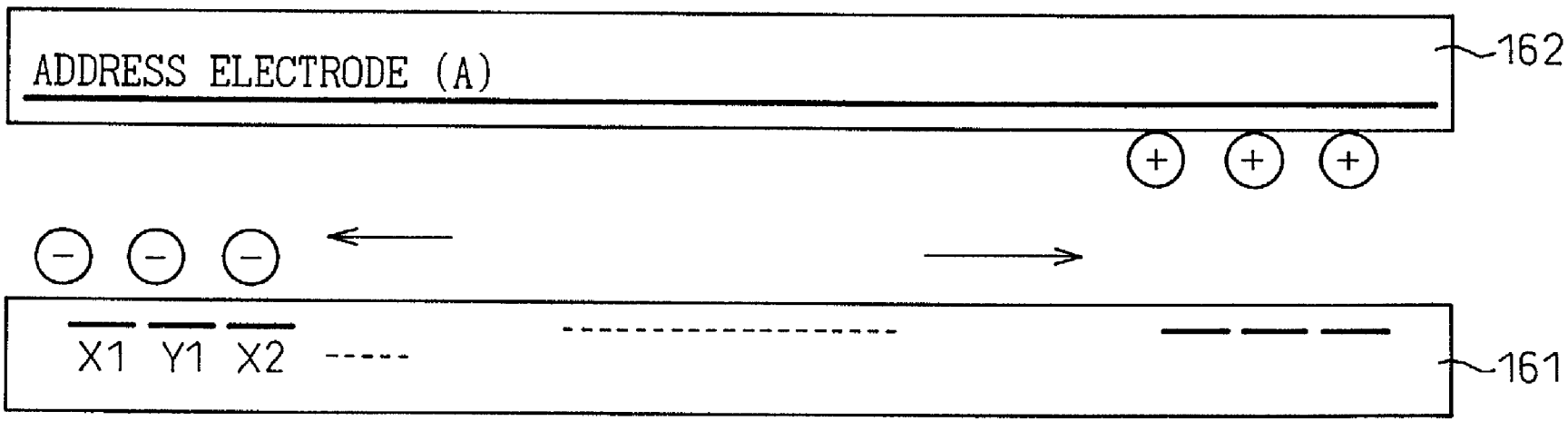
FIG. 13 is a diagram (part 3) for explaining a problem of a fixed display in a PDP of the ALIS system.

Further, as shown in FIG. 13, the distorted charge can be accumulated at the address electrode (A) side of the rear glass substrate 162, or can be accumulated at the sustain electrode (X-electrodes and Y-electrodes) side of the front glass substrate 161. This state is different depending on the time in the driving sequence. For example, in the case of the driving waveform shown in FIG. 5, the address electrodes are always at zero voltage during the sustain period. Therefore, at the end of the sustain period, distorted plus charges are held in the address electrodes. In this case, the wall charge works so as to be superimposed on the applied voltage at the address electrodes when the address discharge is carried out in the next sub-field. This may result in a huge address discharge. When the discharge is larger than a normal address discharge, this may result in an occurrence of an abnormal display such as writing into the adjacent cells.

Figure 14:
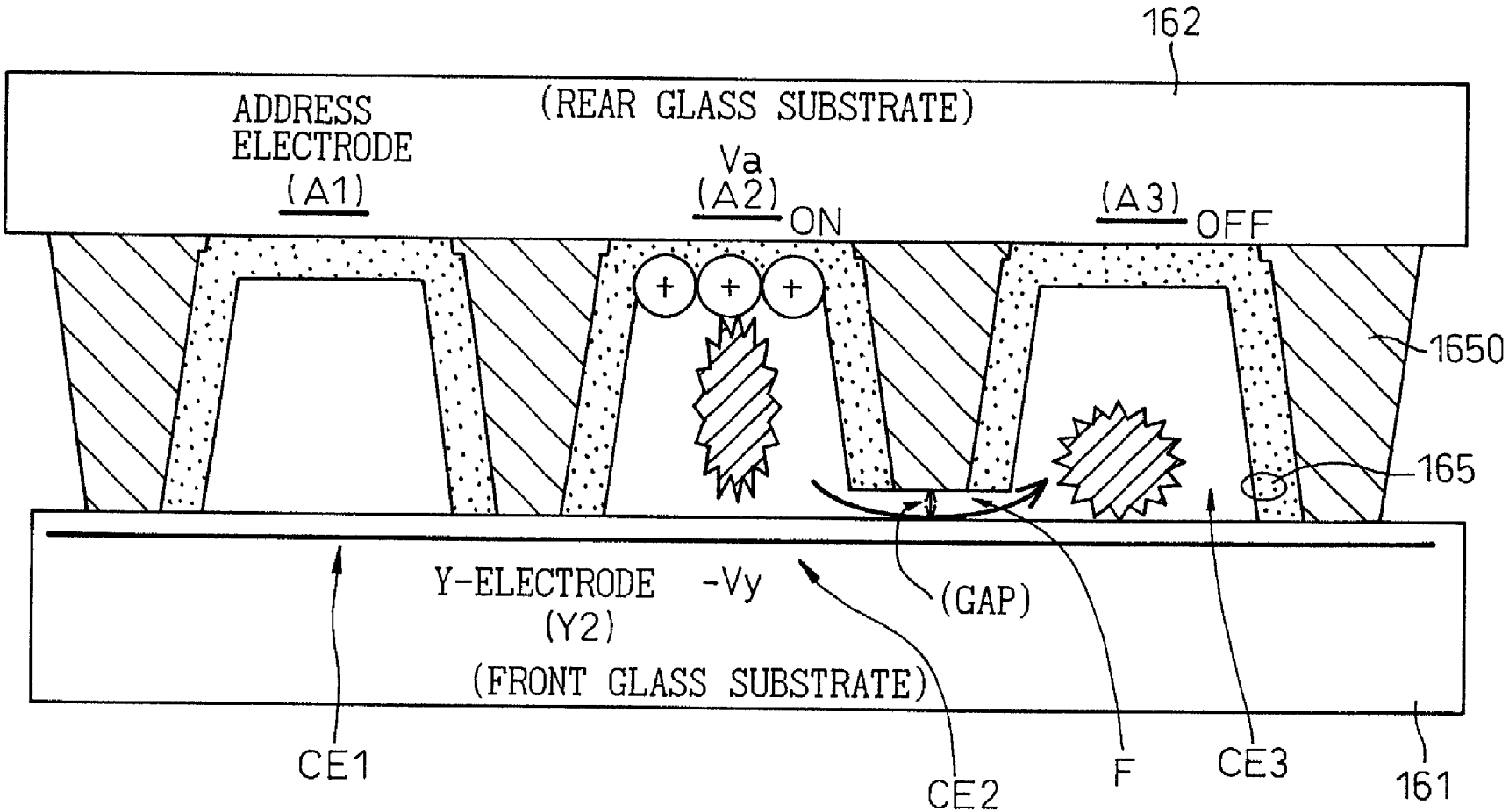
FIG. 14 is a diagram (part 4) for explaining a problem of a fixed display in a PDP of the ALIS system.
Figure 15A:
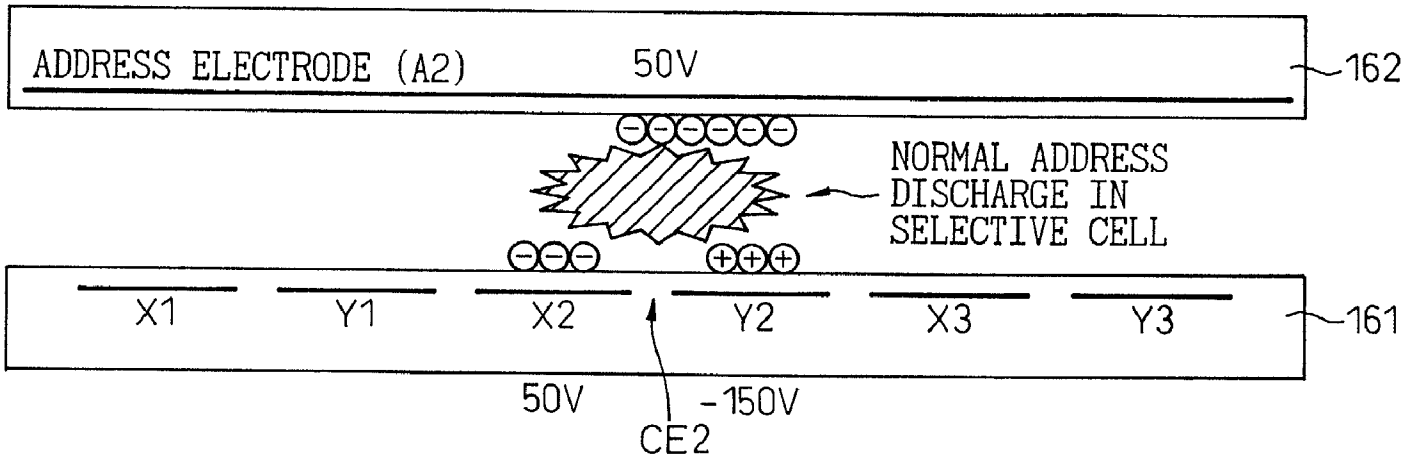
FIG. 15A and FIG. 15B are diagrams (part 5) for explaining a problem of a fixed display in a PDP of the ALIS system.
Figure 15B:
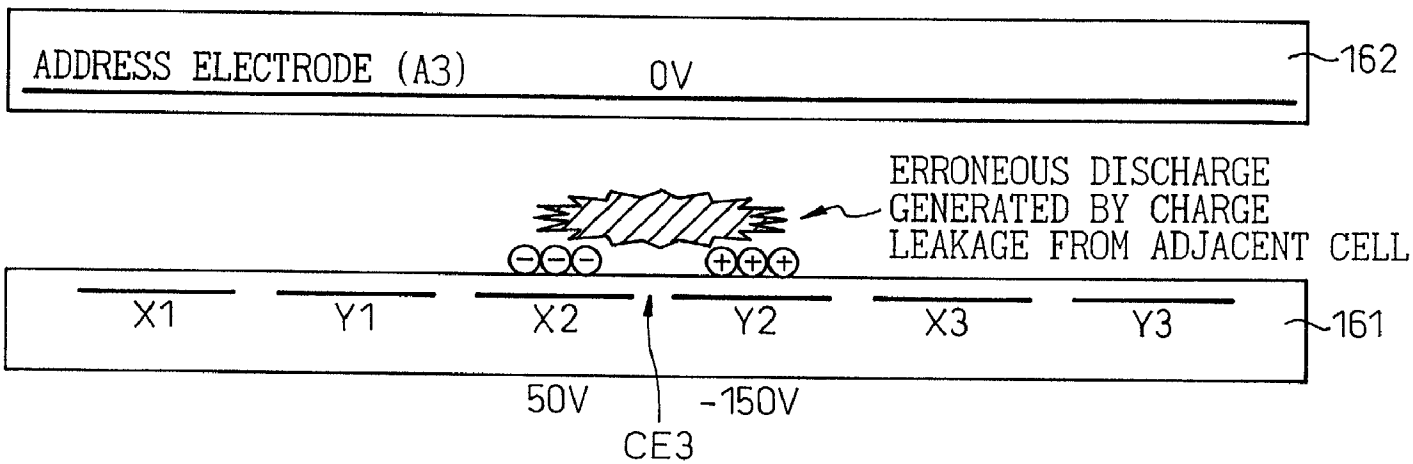

Further, when there is a defect in the partitions or barriers for partitioning the adjacent cells, an abnormal discharge may occur as shown in FIG. 14. In FIG. 14, a reference symbol 165 denotes a phosphor (R1651, G1652, and B1653), and 1650 denotes a partition. FIG. 15A and FIG. 15B show a state that this abnormal discharge occurs.

When an address discharge is carried out in a center cell CE2, and also when cells CE1 and CE3 at both sides of this cell CE2 are in the OFF state, that is, no address discharge is carried out in the cells CE1 and CE3, the following phenomenon may occur. That is, in the above state, when there is a defect F in the partition 1650, a space of the cell CE2 in which the address discharge has been carried out and a space of the adjacent cell CE3 are coupled together, and a charge generated by the address discharge in the cell CE2 moves to the adjacent cell CE3, thereby discharging in the cell CE3. This phenomenon can occur when the defect F of the partition 1650 is a small gap of about 5 $\mu$m. When the address electrode charge becomes huge due to the accumulation of a distorted charge, this invites a discharge in the adjacent cell despite a slight gap. A gap between the front glass substrate 161 and the rear glass substrate 162 is about 100 to 150 $\mu$m, for example.

As a result, after carrying out a normal address discharge in a selected cell as shown in FIG. 15A, an erroneous discharge can occur due to a leakage of a charge from the adjacent cell as shown in FIG. 15B. FIG. 15A shows the cell CE2 that consists of the address electrode A2 and the sustain electrodes (the X-electrode X2 and the Y-electrode Y2), and FIG. 15B shows the cell CE3 that consists of the address electrode A3 and the sustain electrodes (X2 and Y2).

Embodiments of a method of driving a plasma display panel (PDP) relating to the present invention will be explained in detail below with reference to the drawings.

First, a driving waveform in a first embodiment of a method of driving a PDP according to the present invention will be explained in comparison with a driving waveform according to a conventional method of driving a PDP.

Figure 16:
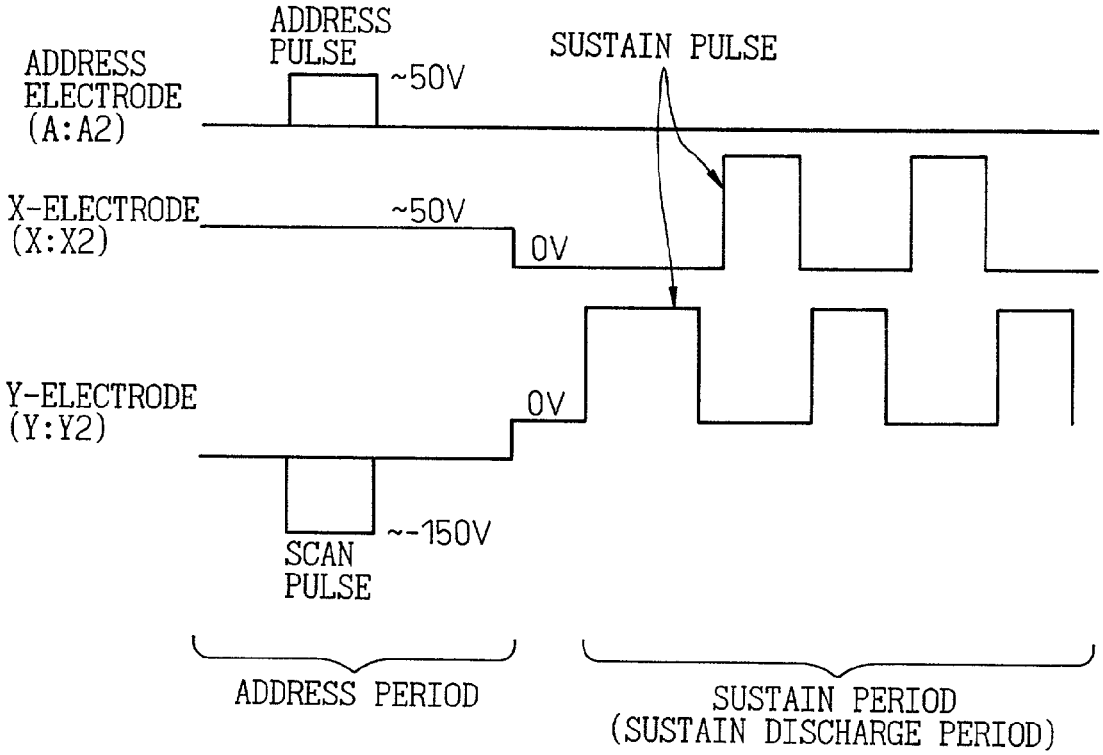
FIG. 16 is a diagram showing one example of a driving waveform according to a conventional method of driving a PDP.
Figure 17:
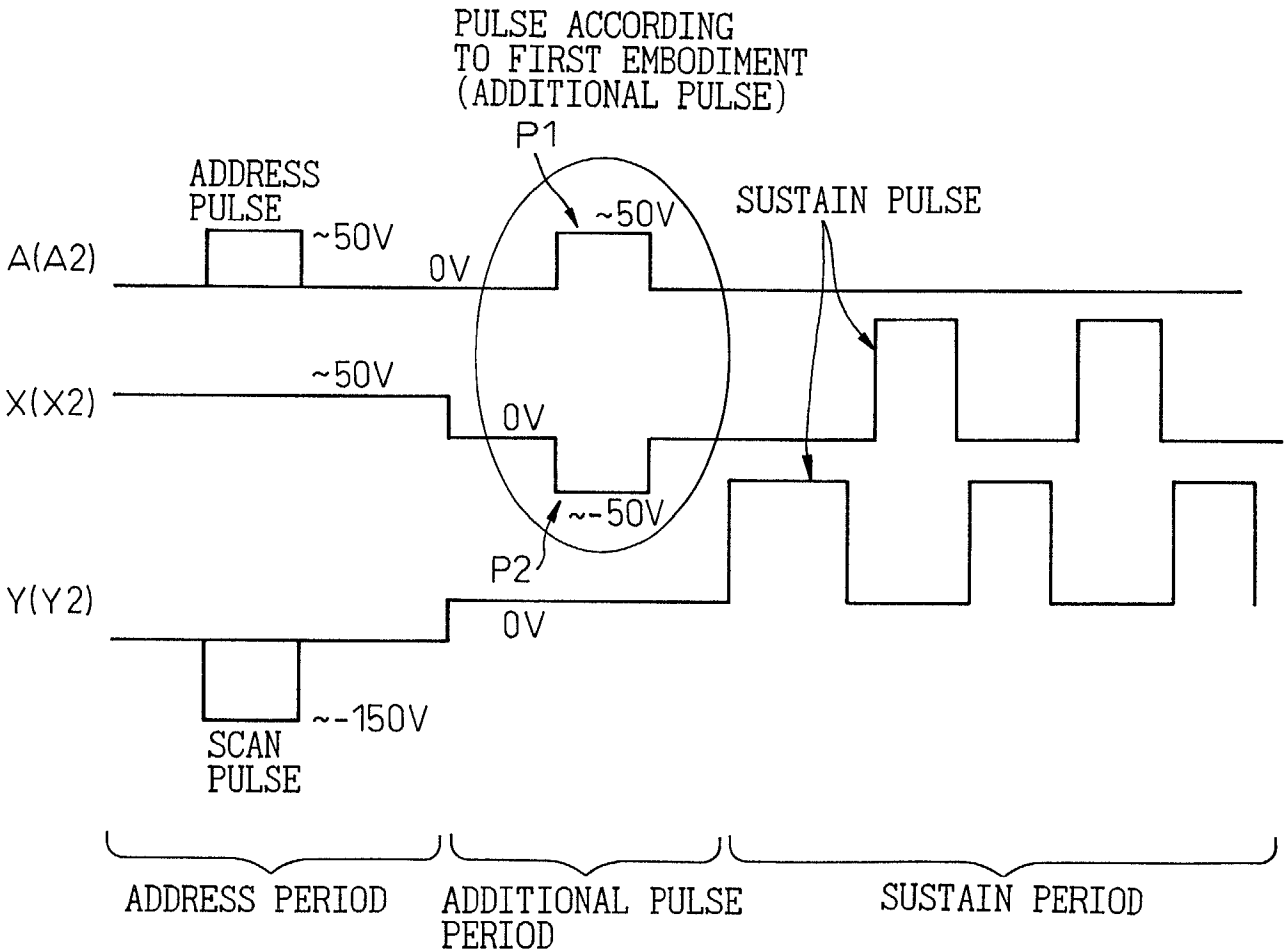
FIG. 17 is a diagram showing a driving waveform according to a first embodiment of a method of driving a plasma display panel (PDP) relating to the present invention.

FIG. 16 is a diagram showing one example of a driving waveform according to a conventional method of driving a PDP, and FIG. 17 is a diagram showing a driving waveform according to a first embodiment of a method of driving a PDP relating to the present invention. In FIG. 16 and FIG. 17, a reference symbol A denotes a waveform to be applied to an address electrode (A2), X denotes a waveform to be applied to an X-electrode (X2), and Y denotes a waveform to be applied to a Y-electrode (Y2).

As is apparent from the comparison between FIG. 16 and FIG. 17, according to the first embodiment, additional pulses P1 and P2 are applied to the address electrode (A: A2) and the X-electrode (X: X2) respectively before starting a sustain discharge (before a sustain period) after finishing an address period. With this application, a wall charge of a cell in which an erroneous discharge occurred is extinguished by an auxiliary discharge.

In other words, as shown in FIG. 17, according to the first embodiment, during an additional pulse period between the address period (the address discharge period) and the sustain period (the sustain discharge period), a plus (positive) polarity pulse P1 (in this case, the same voltage as that of the address pulse (for example, 50 V) to simplify the circuit)) is applied to the address electrode, and a minus (negative) polarity pulse (for example, −50 V) is applied to the X-electrode. Based on the application of these pulses (additional pulses), it is possible to generate an auxiliary discharge in only the cell in which an erroneous discharge has occurred.

Figure 18A:
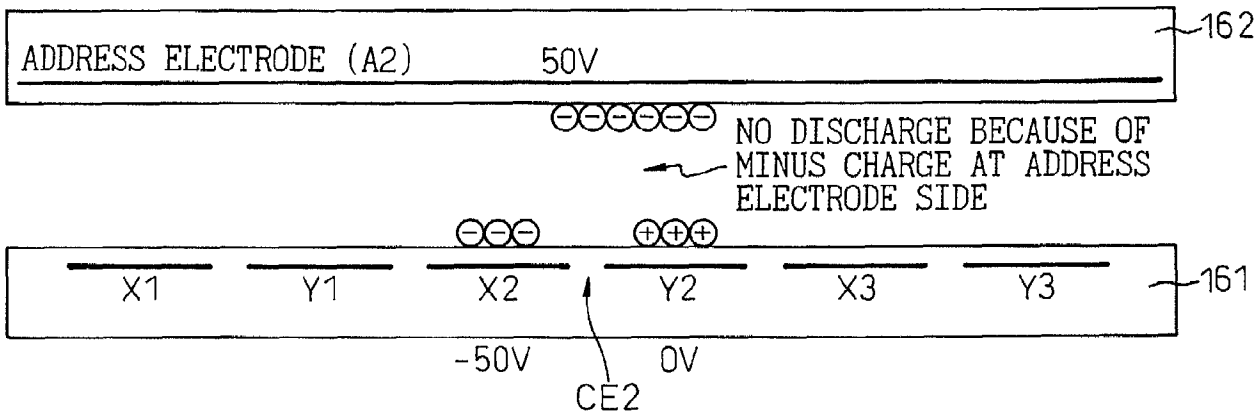
FIG. 18A and FIG. 18B are diagrams for explaining the operation of the method of driving a PDP shown in FIG. 17.
Figure 18B:
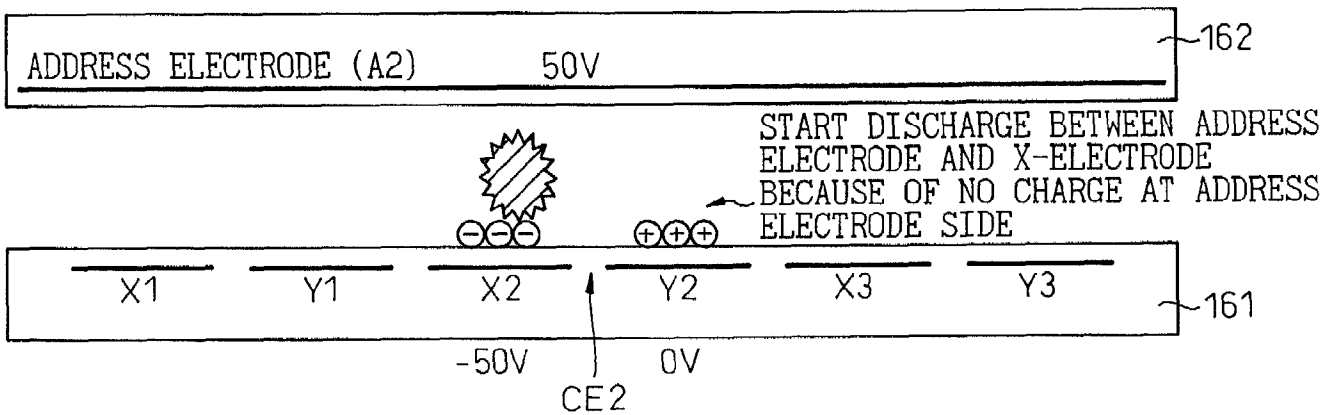

FIG. 18A and FIG. 18B are diagrams for explaining the operation of the method of driving a PDP shown in FIG. 17. FIG. 18A shows a state immediately after an application of the additional pulses shown in FIG. 17 after carrying out the normal address discharge shown in FIG. 15A, and FIG. 18B is a diagram for explaining the operation based on the application of the additional pulses.

As shown in FIG. 18A, a cell (CE2) in which a normal address discharge has been carried out has a negative wall charge formed on the address electrode (A2) side by the address electrode. Therefore, there is no occurrence of a discharge in this cell. On the other hand, as shown in FIG. 18B, in a cell (CE3) in which a discharge has occurred during the address period due to the influence of the adjacent cell (CE2), the address electrode has a non-selected potential of 0 V at the time of this discharge. Therefore, this cell (CE3) is in a state where a charge is not formed even when a discharge is carried out between the X-electrode (X2) and the Y-electrode (Y2).

Thus, as shown in FIG. 17 and FIG. 18B, the positive polarity pulse P1 (for example, 50 V) is applied to the address electrode (A2), and the positive polarity pulse P2 (for example, −50 V) is applied to the X-electrode (X2), thereby starting a discharge between the address electrode (A2) and the X-electrode (X2). After starting the discharge, the discharge converges as the formation of a wall charge progresses. However, as the potential difference between the X-electrode (X2) and the Y-electrode (Y2) is about 50 V, this discharge converges immediately after the starting of this discharge unlike the normal sustain discharge. Further, the wall charge formed has a small valve.

Based on this wall charge of a small valve, a sustain discharge is not started even when a sustain pulse is applied next. As a result, it is possible to realize an extinguished state. When a voltage of the negative polarity pulse P2 to be applied to the X-electrode is too large, a discharge occurs even in the cell in which a normal discharge has been carried out, and this has a potential of erasing the charge. Therefore, it is necessary to set a proper value for this voltage of the pulse P2. According to the first embodiment, about −50 V is a limit. A minimum value of the negative pulse P2 that brings about the effect of the first embodiment is about −30 V.

Figure 19:
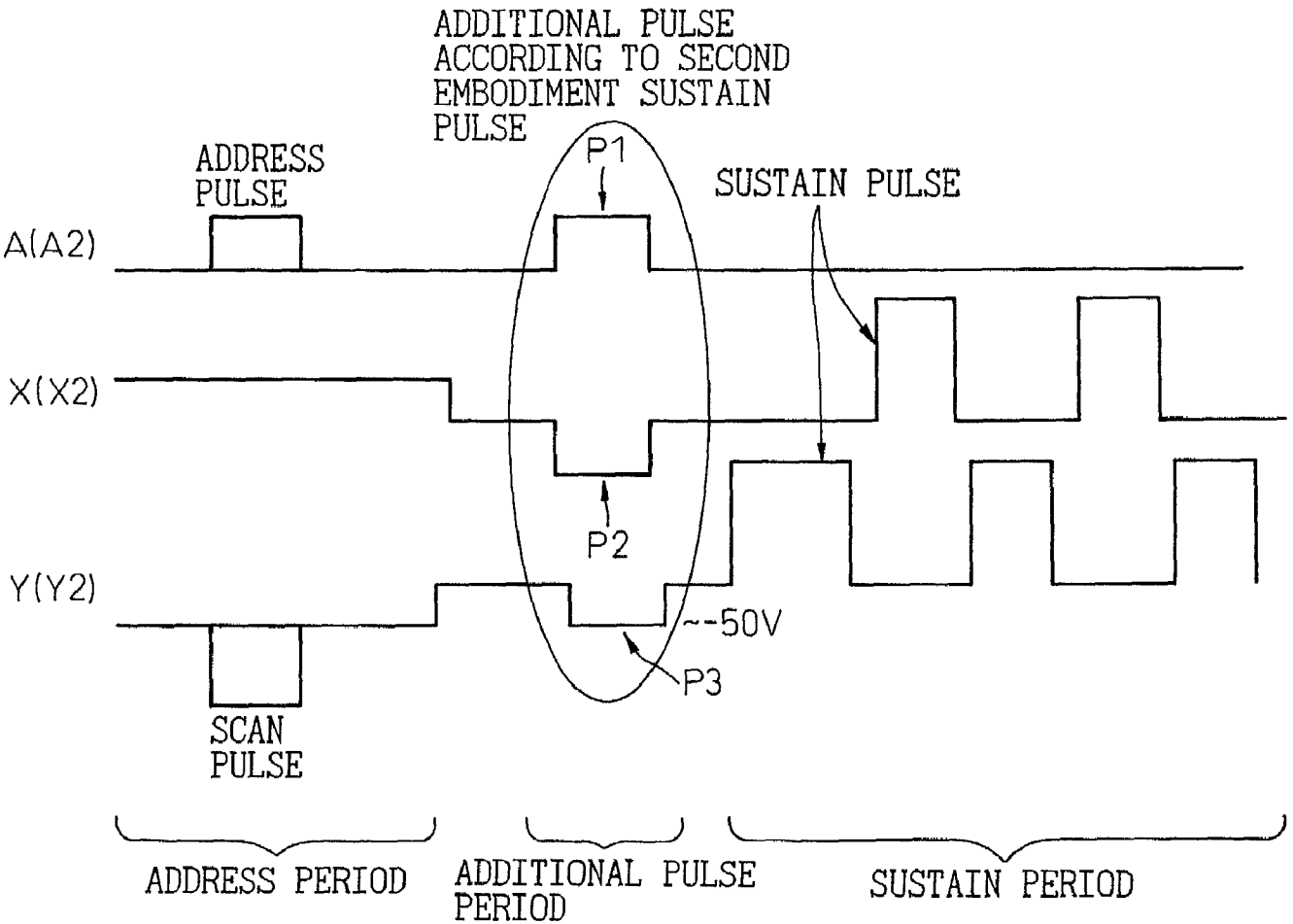
FIG. 19 is a diagram showing a driving waveform according to a second embodiment of a method of driving a PDP relating to the present invention.

FIG. 19 is a diagram showing a driving waveform according to a second embodiment of a method of driving a PDP relating to the present invention.

While the voltage of the Y-electrode (Y2) is 0 V in the first embodiment shown in FIG. 17, a positive charge exists on the Y-electrode (Y2) as shown in FIG. 18A and FIG. 18B. Therefore, when a negative voltage has been applied to the X-electrode (X2) in the cell (CE2) in which a normal address discharge has been carried out, a discharge may occur between the X-electrode (X2) and the Y-electrode (Y2). This has a risk of extinguishing the wall charge formed by the address discharge. In order to prevent the wall charge from being extinguished, according to the second embodiment, a negative polarity pulse P3 is also applied to the Y-electrode (Y2). Based on this arrangement, even when a large negative polarity pulse is applied to the X-electrode, this does not affect the cell in which a normal address discharge has been carried out. Thus, the effect of the present invention can be exhibited securely by the second embodiment. In an experiment, the voltage of the negative polarity pulse (P3) to be applied to the Y-electrode when the address period is set equivalent to that of the non-selective potential (for example, −50 V).

In the above-described first and second embodiments, it is not possible to prevent an occurrence of an erroneous discharge during the address period. However, before entering the sustain period, it is possible to prevent surplus lighting by extinguishing a wall charge of the cell in which an erroneous discharge has occurred.

An embodiment of a method of preventing surplus lighting during the address period will be explained next.

As shown in FIG. 11 to FIG. 14, a huge address discharge is a phenomenon that occurs due to a formation of a charge displaced in one direction when the address discharge is always carried out in the constant direction. Particularly, this phenomenon occurs easily when a positive charge has been formed at the address electrode side as shown in FIG. 13 and FIG. 14. The phosphors 165 exist at the address electrode (A) side, and these phosphors 165 are particles of a few μm having various shapes based on the materials, unlike the MgO film (the protection film) at the sustain electrode (the X-electrode and the Y-electrode) side. In other words, each phosphor 165 forms a film having a size of around 10 microns, with particles of a few μm superimposed on each other. Therefore, each phosphor 165 has hollows in many portions and has a larger surface area in total than that of the Mgo surface. When charged particles like electrons and ions enter these hollows and are adhered to their surface, a small reset discharge or a sustain discharge cannot remove these charged particles. As a result, the charged particles are accumulated and generate a huge discharge.

An embodiment of a method of removing the charged particles will be explained next.

Figure 20:
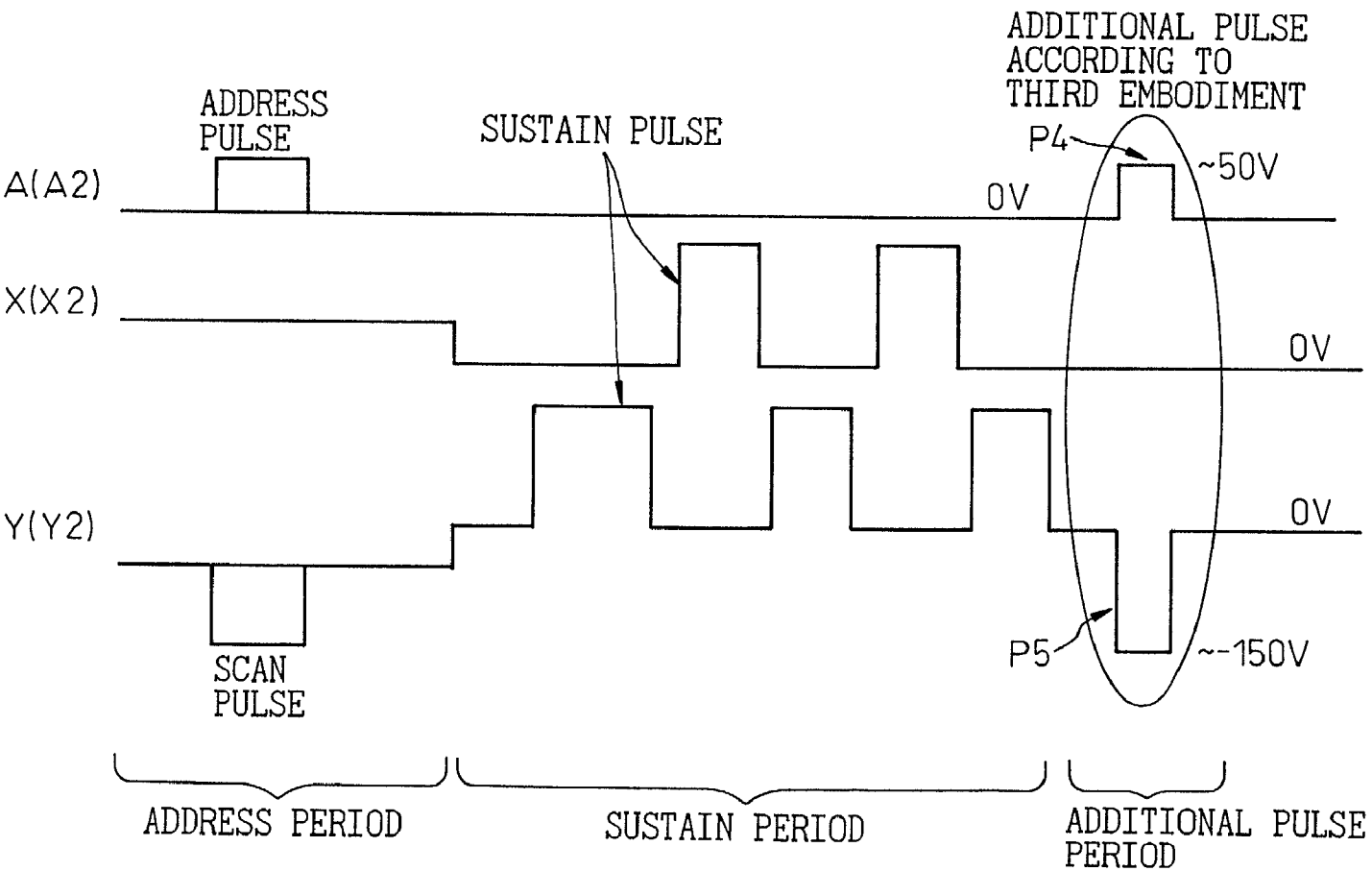
FIG. 20 is a diagram showing a driving waveform according to a third embodiment of a method of driving a PDP relating to the present invention.

FIG. 20 is a diagram showing a driving waveform according to a third embodiment of a method of driving a PDP relating to the present invention.

As is apparent from a comparison between FIG. 20 and FIG. 16, according to the third embodiment, after a normal sustain period has finished, a negative polarity pulse P5 that is equivalent to a voltage (for example, about −150 V) of a scan pulse is applied to the Y-electrode (Y2), and a positive polarity pulse P4 that is equivalent to a voltage (for example, about 50 V) of an address pulse is applied to the address electrode (A2). These additional pulses P4 and P5 are inserted after discharge by the positive polarity sustain pulse of the Y-electrode. Therefore, a discharge between the X-electrode and the Y-electrode and a discharge between the address electrode and the Y-electrode are carried out together. As a result, a large discharge (an auxiliary discharge) is generated, and this can remove the positive charge piled up at the address electrode side.

Figure 21:
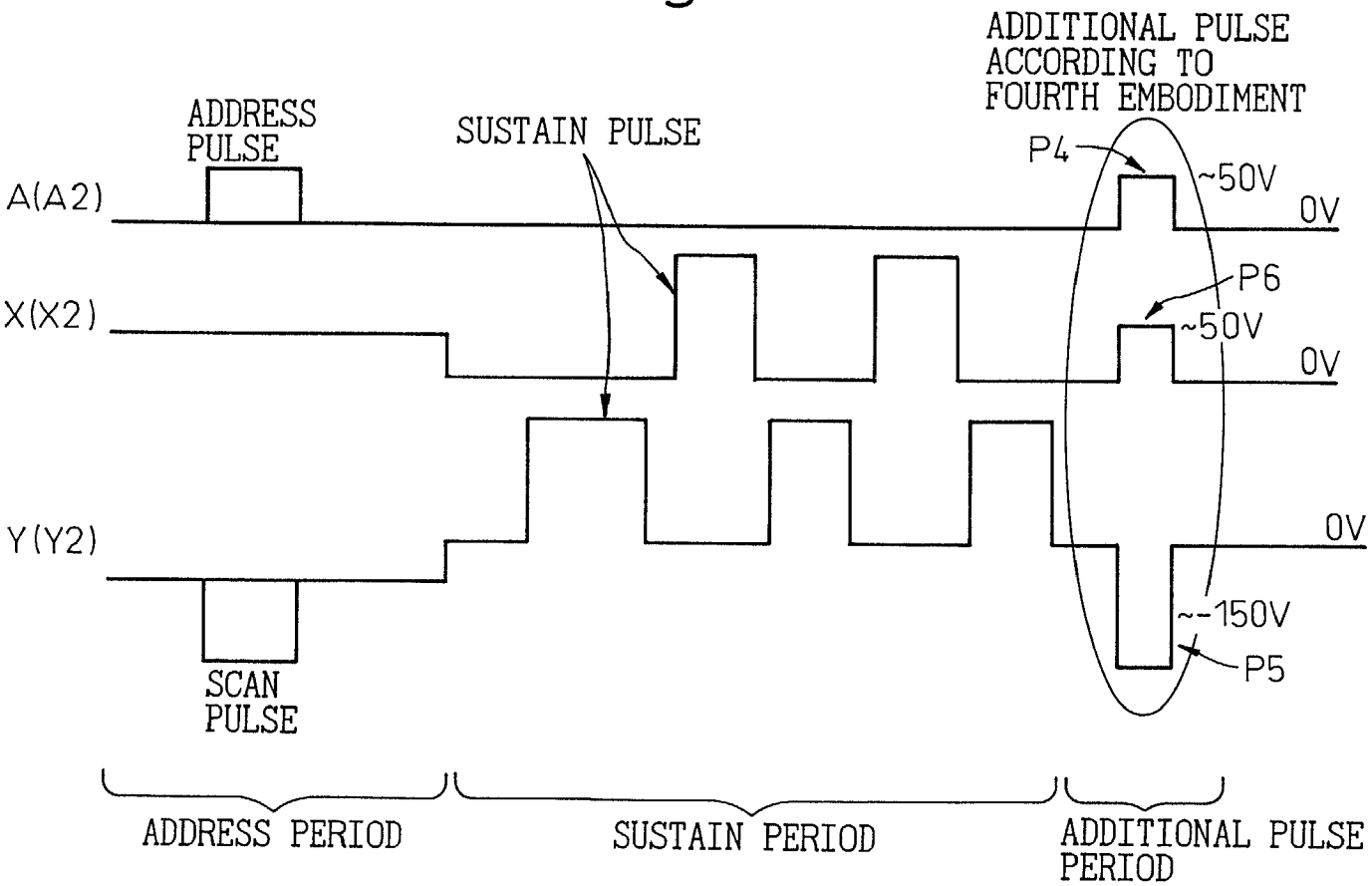
FIG. 21 is a diagram showing a driving waveform according to a fourth embodiment of a method of driving a PDP relating to the present invention.

FIG. 21 is a diagram showing a driving waveform, according to a fourth embodiment, of a method of driving a PDP relating to the present invention.

As is apparent from a comparison between FIG. 21 and FIG. 20, according to the fourth embodiment, a positive polarity pulse P6 is also applied to the X-electrode (X2) during the additional pulse period after finishing the sustain period of the third embodiment. Based on this application, a larger discharge (an auxiliary discharge) is generated during the additional pulse period. This can more effectively remove the charge piled up at the address electrode side. The voltage of the additional pulse P6 to be applied to the X-electrode may be equivalent to that (for example, about 50 V) applied to the X-electrode during the address period, for example.

Figure 22:
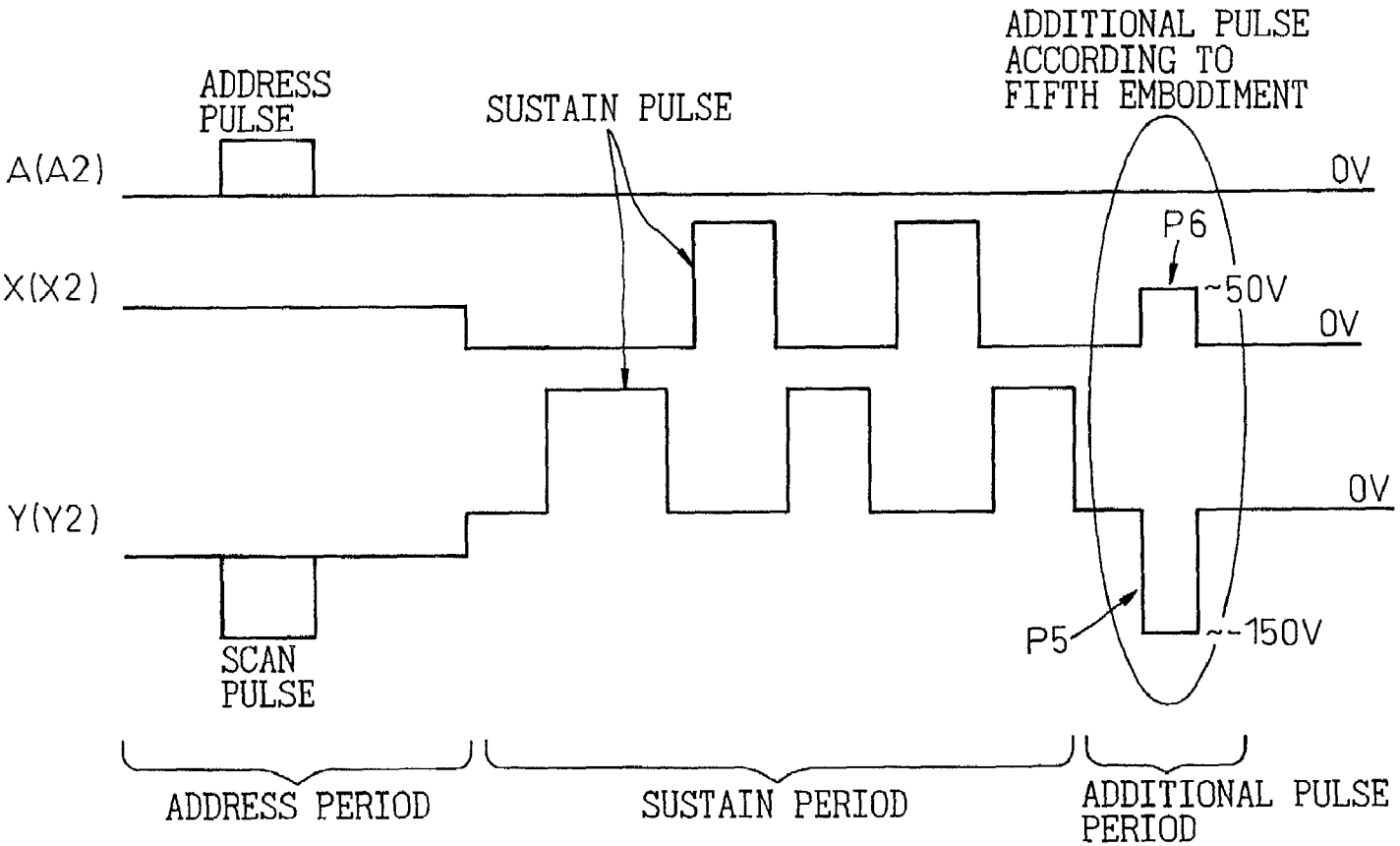
FIG. 22 is a diagram showing a driving waveform according to a fifth embodiment of a method of driving a PDP relating to the present invention.

FIG. 22 is a diagram showing a driving waveform according to a fifth embodiment of a method of driving a PDP relating to the present invention.

According to the above-described third embodiment shown in FIG. 20 and fourth embodiment shown in FIG. 21, the additional pulse P4 is added to the address electrode (A2). Therefore, depending on the voltage between the address electrode (A2) and the Y-electrode (Y2), there is a case where a discharge is generated in all cells in which lighting has been extinguished.

A discharge is generated securely in all the cells when the additional pulse P4 to be applied to the address electrode is set equivalent to that (for example, about 50 V) of the address pulse during the address period and also when the additional pulse P5 to be applied to the Y-electrode (Y2) is set equivalent to that (for example, about −150 V) of the scan pulse. In other words, as the discharge is generated in all the cells even when the lighting on the screen is in the extinguished (a black display) state, the brightness of the black increases, and this can lower the contrast.

Therefore, as shown in FIG. 22, according to the fifth embodiment, the additional pulse P4 is not applied to the address electrode (A2), and the additional pulses P6 and P5 are applied to the X-electrode (X2) and the Y-electrode (Y2) respectively so that an intensive discharge is carried out only between the X-electrode and the Y-electrode. According to the fifth embodiment, it is also possible to obtain the effect of preventing an abnormal discharge by removing the charge piled up at the address electrode side by the auxiliary discharge during the additional pulse period, although this effect is not as large as that obtained by the fourth embodiment.

The above-described driving method (additional pulses) of the third to fifth embodiments of the present invention may be implemented in all the sub-fields. However, this has a risk of lowering the contrast as described above. Therefore, it is also effective to implement the above driving method only once in one field.

While a description has been made of a case where the present invention is applied to mainly a PDP of the ALIS system (particularly the display of the odd lines), the application of the present invention is not limited to the PDP of the ALIS system. It is also possible to widely apply the present invention to a PDP in which a charge can easily move between adjacent cells (for example, between upper and lower adjacent cells) with short pitches of the cells in which a discharge is carried out.

Figure 23:
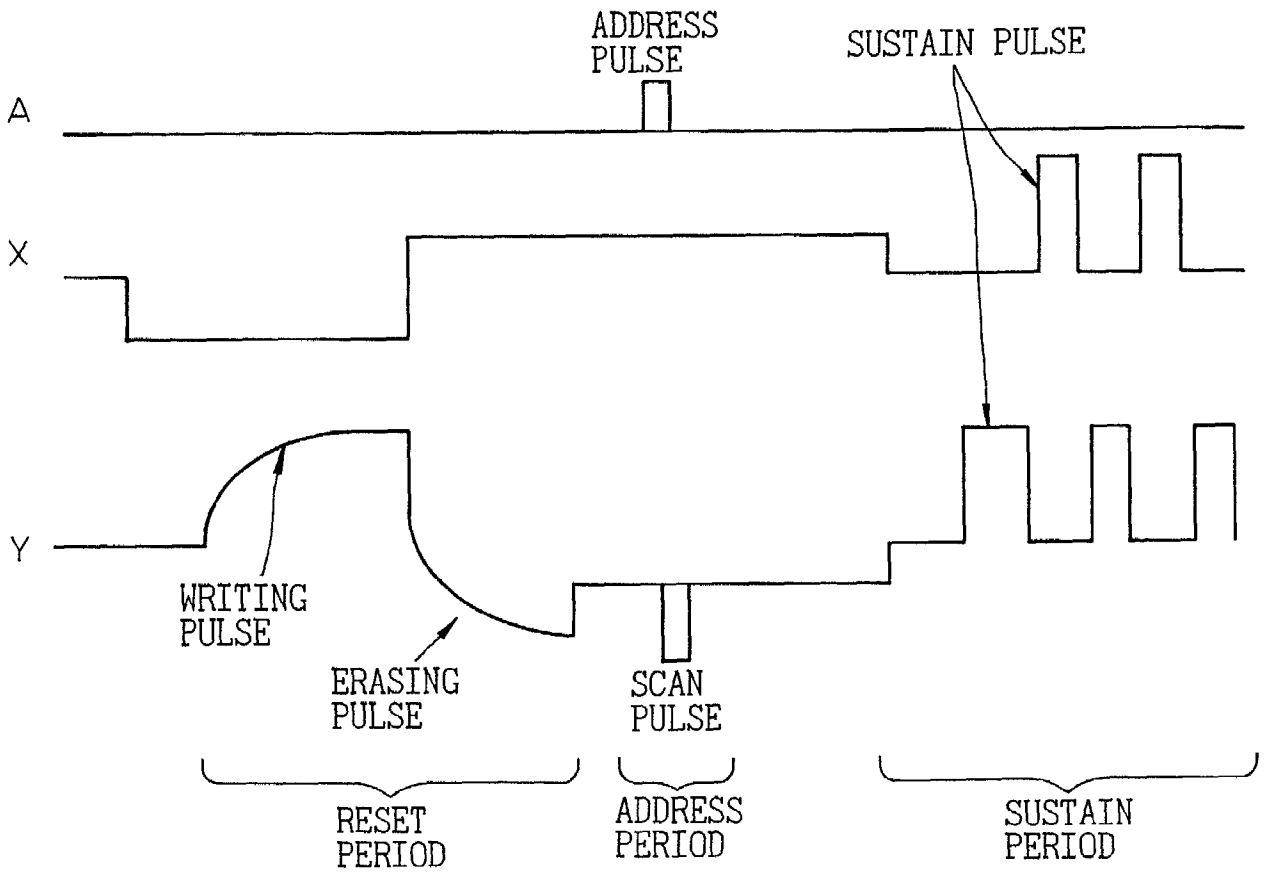
FIG. 23 is a diagram showing another example of a driving waveform according to a conventional method of driving a PDP.

FIG. 23 is a diagram showing another example of a driving waveform according to a conventional method of driving a PDP. This shows a conventional example in comparison with an embodiment to be described later with reference to FIG. 24.

The conventional example shown in FIG. 23 is characterized in a reset pulse shape. According to this method, a pulse with a less steep inclination is applied as a reset pulse, and a write discharge is carried out over all the cells. Thereafter, an erasing pulse with a less steep inclination is similarly applied to erase the wall charge. This method is characterized in that, as the inclination of the pulse is less steep, the discharge intensity is very small and the light emission volume is also small. Therefore, even when a reset (write/erase) discharge is executed in all sub-fields in all the cells, the dark contrast is not lowered because of a slight brightness. As a result, it is possible to obtain a stable operation and high display quality. Details of this driving technique are disclosed in, for example, Japanese Unexamined Patent Publication (Kokai) No. 10-170825.

According to this method, however, a scale of discharging becomes small as the inclination of the erasing waveform becomes less steep. Therefore, this has a problem in that the erasing of the wall charge becomes insufficient over the whole range of cells. In other words, even when wall charges on the phosphors above the X-electrodes (X), the Y-electrodes (Y) and the address electrodes (A) can be erased sufficiently, wall charges adhered to the phosphors on the side surfaces of the partitions (barriers) cannot be erased sufficiently. As a result, there has been a problem that a discharge is started based on only the erasing pulse without an application of the address pulse during the address period.

Figure 24:
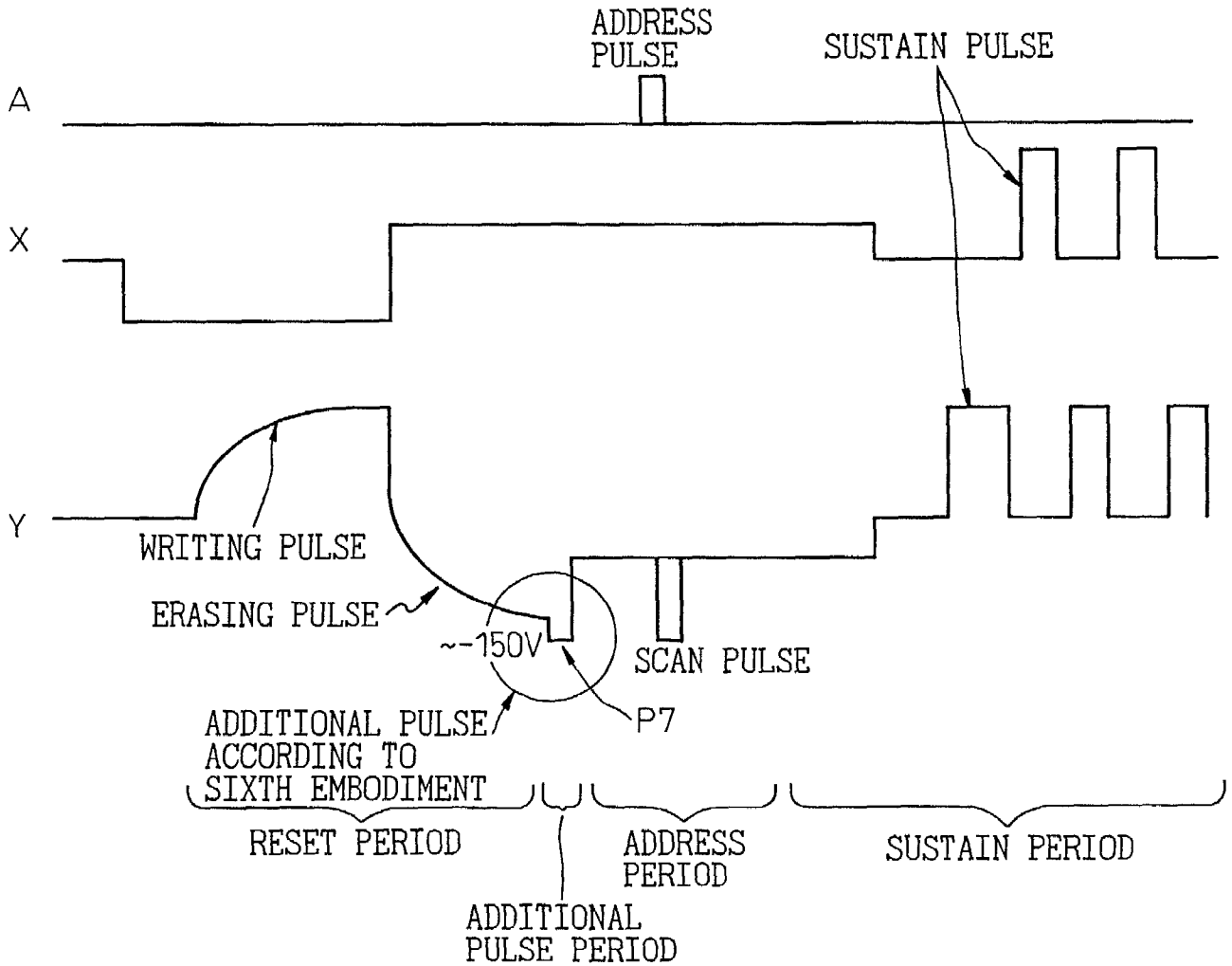
FIG. 24 is a diagram showing a driving waveform according to a sixth embodiment of a method of driving a PDP relating to the present invention.

FIG. 24 is a diagram showing a driving waveform according to a sixth embodiment of a method of driving a PDP relating to the present invention.

As shown in FIG. 24, according to the sixth embodiment, an additional pulse P7 of a voltage equivalent to that (for example, about −150 V) of the scan pulse is applied for a short period of a few microseconds at the end of the erasing pulse. Based on this application, a discharge of a relatively large scale is generated to neutralize the wall charge, thereby avoiding an erroneous address.

More specifically, it has been confirmed that it is effective to set a voltage change of about 5 to 10 V to the additional pulse P7 that is rapidly applied at the 5 end of the erasing pulse, and to set the application time of this additional pulse P7 to about 1 to 5 $\mu$m, for example.

The application conditions of the additional pulse P7 to be applied at the end of the erasing pulse are different depending on the structure of the cells, and the voltage application during the address period and the sustain period. Therefore, the application conditions can be changed depending on the cases.

As explained above, according to the sixth embodiment, based on a secure reset operation (erase discharge), it is possible to prevent an occurrence of an erroneous address operation where a discharge is caused by only the erasing pulse without applying the address pulse during the address period.

Figure 25:
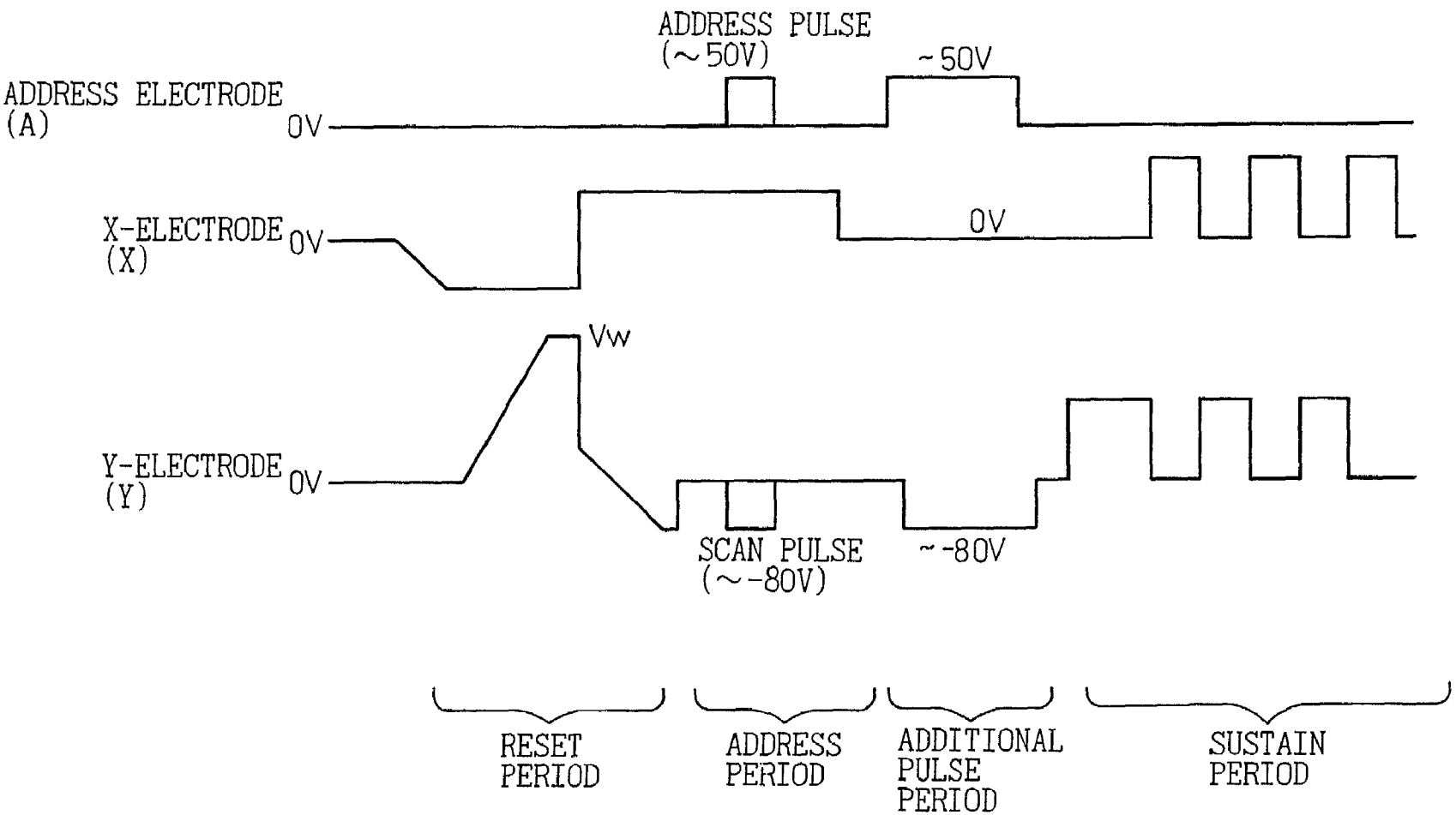
FIG. 25 is a diagram showing a driving waveform according to a seventh embodiment of a method of driving a PDP relating to the present invention.

FIG. 25 is a diagram showing a driving waveform according to a seventh embodiment of a method of driving a PDP relating to the present invention, and FIGS. 26A to 26D are diagrams for explaining the operation of the method of driving a PDP shown in FIG. 25.

In the seventh embodiment, so as to decrease an applying voltage of a scan pulse lower than about −150 V to −100 V (for example, −80 V), a reset voltage (Vw) is set to a high voltage, and after finishing a reset discharge, or before starting an address period, a wall charge to be applied over an address pulse or a scan pulse is accumulated.

Figure 26A:
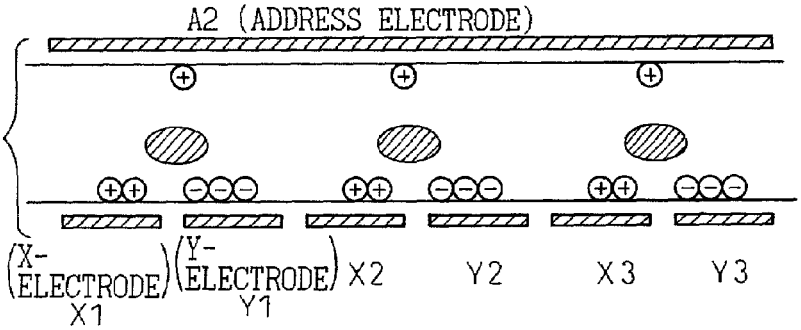
FIG. 26A, FIG. 26B, FIG. 26C and FIG. 26D are diagrams for explaining the operation of the method of driving a PDP shown in FIG. 25.

FIG. 26A shows a state of the wall charge at the end of (at the time of finishing) a reset period, where the wall charge having a positive polarity is accumulated on X-electrodes (X1, X2, X3) and an address electrode (A2), and the wall charge having a negative polarity is accumulated on Y-electrodes (Y1, Y2, Y3). Therefore, it is possible to carry out an address discharge by using a voltage lower than that used in the above described driving method with reference to FIGS. 5 and 6.

Figure 26B:
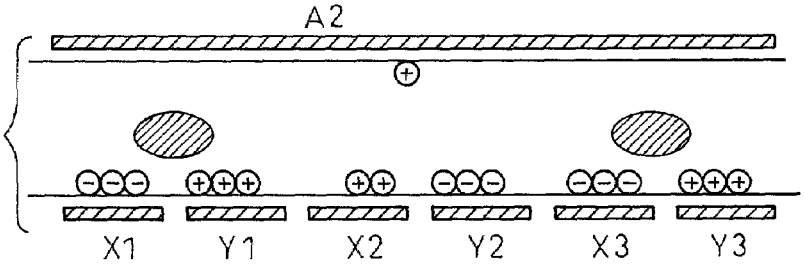

Specifically, in this seventh embodiment, for example, a voltage of the address pulse is at −50 V, a voltage of the Y-electrode is at −130 V and a voltage of the Y-electrode is at −80 V, and an applying voltage between the adders electrode and the Y-electrode, which is, for example, over 200 V in the prior art, can be decreased about 130 V. FIG. 26B shows a state after carrying out address discharges in cells of the X1-Y1 electrodes and the X3-Y3 electrodes (cells positioned between the X1-electrode and the Y1-electrode and cells positioned between the X3-electrode and the Y3-electrode). Note that, when cells of the X2-Y2 electrodes (cells positioned between the X2-electrode and the Y2-electrode) are turned off, where an address discharge is not caused, as shown in FIG. 26B, the wall charge (which is caused at the time of carrying out the reset discharge) is accumulated. In this situation, when starting a sustain discharge, in the turned-off cell, where the wall charge is accumulated, an erroneous discharge may be caused by an influence of the neighboring lighting cell (Priming Effect).

Figure 26C:
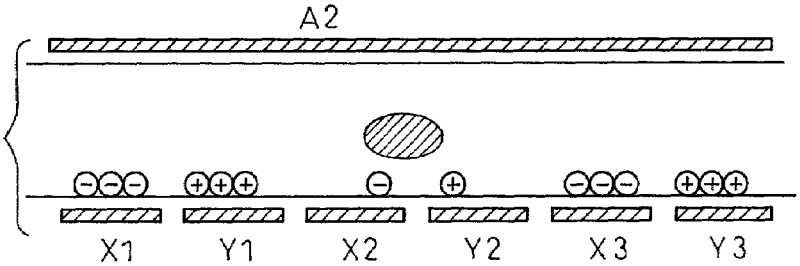
Figure 26D:
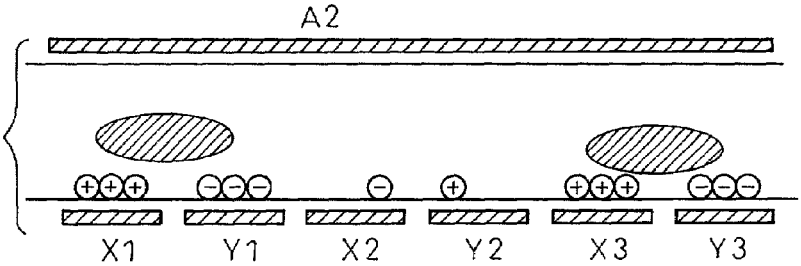

Therefore, in the seventh embodiment, an additional pulse period is inserted before a sustain (discharge) period, as shown in FIG. 25. In the additional pulse period, a voltage (for example, 50 V), which is the same as that of the address pulse, is applied to the address electrode, and a voltage (for example, −80 V), which is the same as that of the scan pulse, is applied to the Y-electrode, so as to cause a discharge (further auxiliary discharge) between the address electrode and the Y-electrode and to extinguish the wall charge of the turned-off cell, as shown in FIG. 26C. Therefore, by this action, it can be prevented that the turned-off cell becomes lit (turned-on) in the sustain period, as shown in FIG. 26D.

Here, the additional pulse period can be established at about 10 to 20 $\mu$sec. Further, in the additional pulse period of FIG. 25, the wall charge between the X-electrode and the Y-electrode becomes small even if the discharge occurs between the address electrode and the Y-electrode, because the voltage of the X-electrode is set at 0 V. In addition, the applying voltage used in the additional pulse period can be variously changed without setting it at the same voltage as that of the address pulse or the scan pulse.

Figure 27:
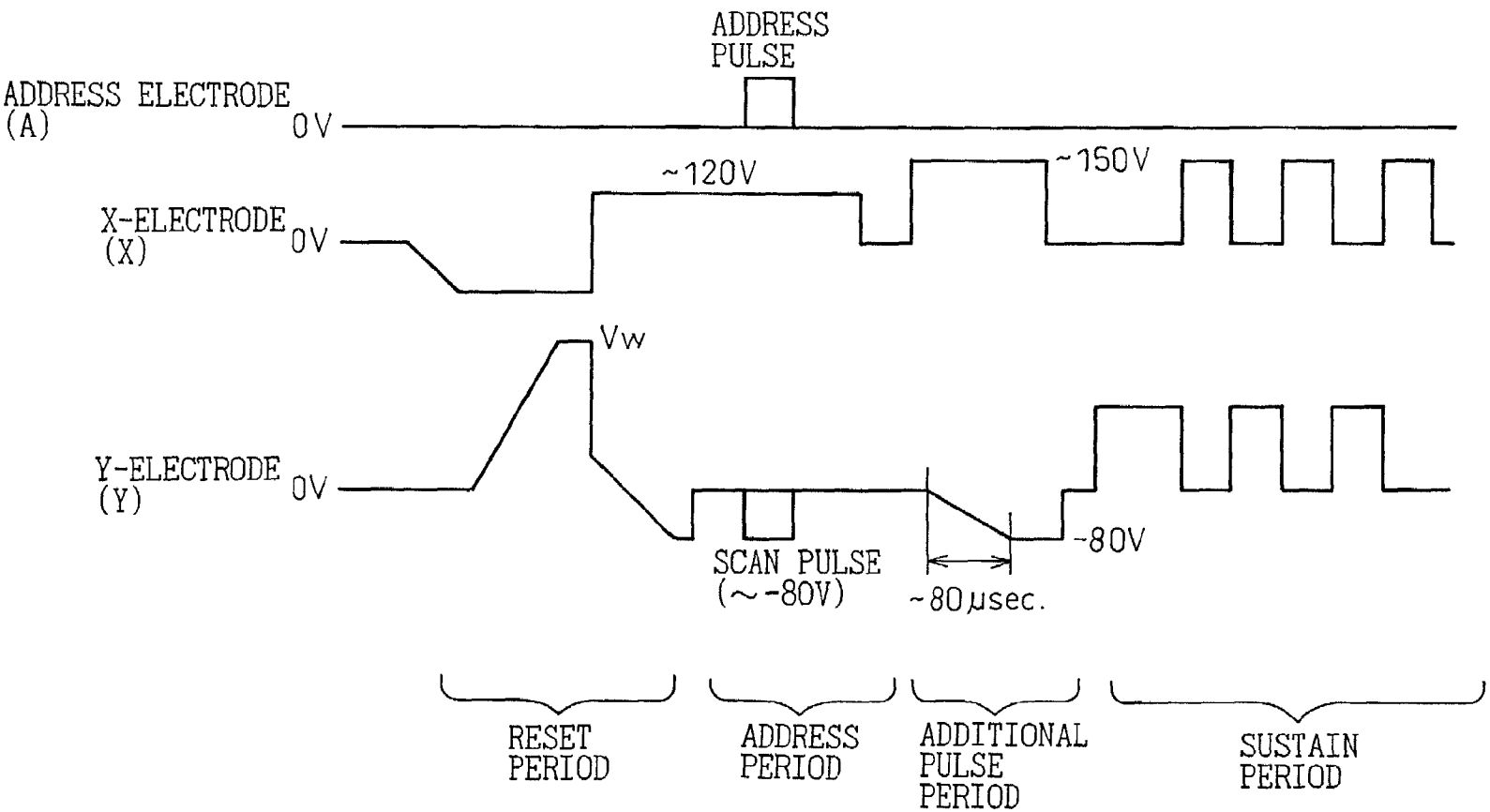
FIG. 27 is a diagram showing a driving waveform according to an eighth embodiment of a method of driving a PDP relating to the present invention.

FIG. 27 is a diagram showing a driving waveform according to an eighth embodiment of a method of driving a PDP relating to the present invention.

In the above described seventh embodiment with reference to FIG. 25, the wall charge of the turned-off cell caused after finishing the address period is processed (reduced) by the discharge caused between the address electrode and the Y-electrode. On the other hand, in the eighth embodiment, the wall charge is reduced by a discharge caused between the X-electrode and the Y-electrode.

Specifically, as shown in FIG. 27, in the additional pulse period between the address period and the sustain period, a voltage (for example, the same voltage as the sustain discharge pulse: 150 V), which is higher than the applied voltage of the X-electrode in the address period, is applied to the X-electrode, and a pulse having a less steep inclination (for example, an inclination of 1 V/μsec.) and having the same voltage (for example, −80 V) as the scan pulse is applied to the Y-electrode.

The wall charge between the X-electrode and the Y-electrode of the turned-off cell is extinguished by a small discharge caused by applying the less steep inclination pulse, and the erroneous discharge in the sustain period can be prevented. Here, the additional pulse period is, for example, about 80 to 90 μsec. Further, in the eighth embodiment, the applied voltage used in the additional pulse period can be variously changed without setting it at the same voltage as that of the address pulse or the scan pulse.

Figure 28:
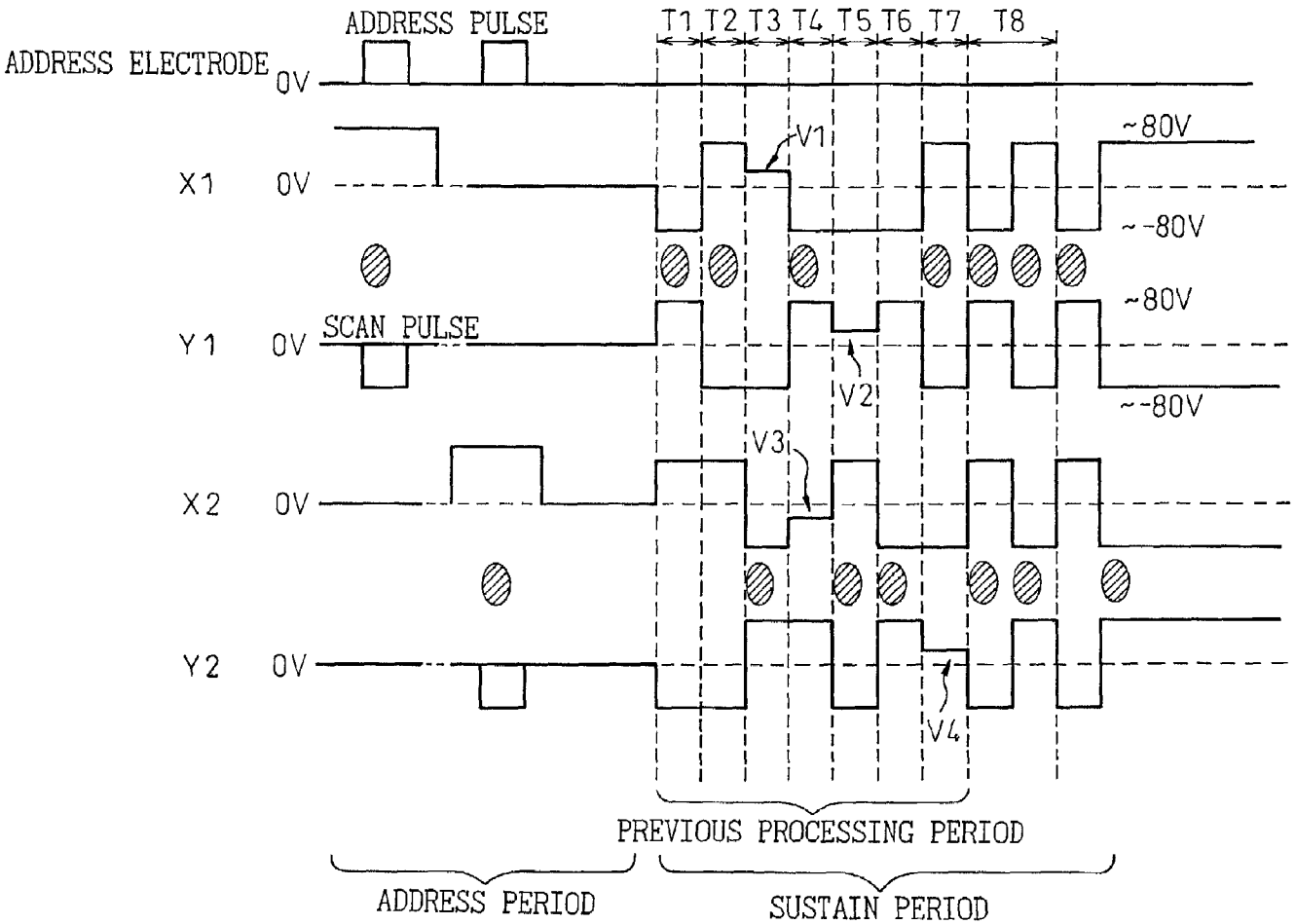
FIG. 28 is a diagram showing a driving waveform according to a ninth embodiment of a method of driving a PDP relating to the present invention.

FIG. 28 is a diagram showing a driving waveform according to a ninth embodiment of a method of driving a PDP relating to the present invention.

As is apparent from a comparison between FIG. 25 and 27 and FIG. 28, in the ninth embodiment the additional pulse period for extinguishing the wall charge of the turned-off cell with using an exclusive pulse is not newly provided, but the wall charge of the turned-off cell is extinguished by carrying out the sustain discharge in the sustain period. Here, in the ninth embodiment (FIG. 28), a voltage required for the sustain discharge is alternately applied as a half from the X-electrode and a half from the Y-electrode. Specifically, voltages of 0 V and 160 V are not applied to the X-electrodes and the Y-electrodes, but, for example, voltages of 80 V and −80 V are applied thereto. In the ninth embodiment, the reset processing, where the wall charge is accumulated so as to decrease the applying voltage for the address discharge, is the same as the above described seventh and eighth embodiments.

As shown in FIG. 28, in periods T1 and T2, negative and positive voltages (−80 V and 80 V) are applied between the X-electrodes and the Y-electrodes so as to carry out a discharge. Next, in a period T3, a discharge is caused on cells of the X2-Y2 electrodes, where a voltage of the X1-electrode is set at V1 (for example, about 50 to 60 V which is lower than the voltage of 80 V by about 20 to 30 V) which is lower than +Vs/2. Similarly, in periods T4, T5 and T7, the voltage of the X1-electrode is also set at the above lowered voltage.

The basic concept of the ninth embodiment is that, in an initial stage (preceding process period) of the sustain period, discharge timings for cells of the X1-Y1 electrodes and discharge timings for cells of the X2-Y2 electrodes are oppositely carried out. In the case that the cells of the X1-Y1 electrodes and the cells of the X2-Y2 electrodes are both turned-on (lit), when a discharge is caused on first cells of the X1-Y1 and the X2-Y2 electrodes, a voltage for applying to second cells of the X1-Y1 and the X2-Y2 electrodes is lowered, so as not to receive the influence of the discharge of the turned-on cells. Further, in the case that the first cells of the X1-Y1 and the X2-Y2 electrodes are turned on and the second cells of the X1-Y1 and the X2-Y2 electrodes are turned off (not lit), during a discharge is caused on the turned-on cells, the discharge is further caused on the turned-off cells, and thereafter, the turned-off cells are not turned on.

The above operation will be described in accordance with a time base with reference to FIG. 28. First, in the periods T1 and T2, a discharge is caused on cells of the X1-Y1 electrodes (cells positioned between X1-electrode and Y1-electrode), where cells of the X2-Y2 electrodes are in a ready state. At this time, the above discharge, which is after the address discharge, is small, and this discharge does not diffuse to the neighboring cells, so that special voltages, which are used to prevent a discharge on the neighboring cells and are applied to the X2-electrode, and the Y2-electrode, are not necessary.

Next, in the period T3, a sustain discharge is caused on the cells of the X2-Y2 electrodes. At this time, when the cells of the X1-Y1 electrodes are turned off, a positive wall charge, which is caused during the reset process, exists on the X1-electrode. Therefore, when the voltage of the X1-electrode is at a high, this X1-electrode and the Y2-electrode are considered as positive electrodes (anodes) from the X2-electrode. Therefore, a discharge is not only caused between the X2-electrode and the Y2-electrode, but the discharge is also caused on the X2-electrode and the X1-electrode, so that the sustain discharge is caused on the X1-electrode due to a large amount of negative charge (electrons) of the X1-electrode. Here, in FIG. 28, the X-electrodes and the Y-electrodes are described as only four, however, for example, an X3-electrode corresponding to the X1-electrode can be located below the Y2-electrode.

In the ninth embodiment, the voltage of the X1-electrode is set lowered (V1: for example, 50 to 60 V), and therefore, a large scale discharge involving the X1-electrode does not occur. Specifically, according to the ninth embodiment, the wall charge of the positive polarity caused on the X1-electrode is extinguished by negative charges (electrons).

Next, in the period T4, the cells of the X1-Y1 electrodes cause a third sustain discharge. At this time, the voltage of the X2-electrode is changed toward a plus (V3: for example, −50 to −60 V), and therefore, a discharge between the Y1-electrode and the X2-electrode can be avoided.

In the period T5, the voltage of the Y1-electrode is lowered and, in the period T7, the voltage of the Y2-electrode is lowered to a voltage (V4: for example, 50 to 60 V). This process is used to extinguish the negative wall charge caused on the Y-electrodes during the reset period, when the cells of the Y1-electrode or the Y2-electrode are turned-off. Concretely, in the period T5, the cells of the X1-Y1 electrodes are turned off and a negative wall charge caused by the reset period is accumulated on the Y1-electrode, the voltage of the Y2-electrode is lowered to a minus valve (for example, to a voltage V2) and, therefore, a feeble discharge is caused between the X2-electrode and the Y1-electrode. At this time, a feeble positive wall charge is accumulated on the Y1-electrode, but the voltage of the Y1-electrode is lower than a discharge starting voltage, and therefore, no discharge caused. Here, the operation of the period T7 is the same as that of the period T5.

In the ninth embodiment, the voltages V1 to V4 are generated by a power supply circuit. However, these voltages V1 to v4 are not output voltages of an exclusive power supply circuit. For example, the voltages V1 to V4 can be obtained by controlling an output circuit shown in FIG. 29 to a high impedance state.

Figure 29:
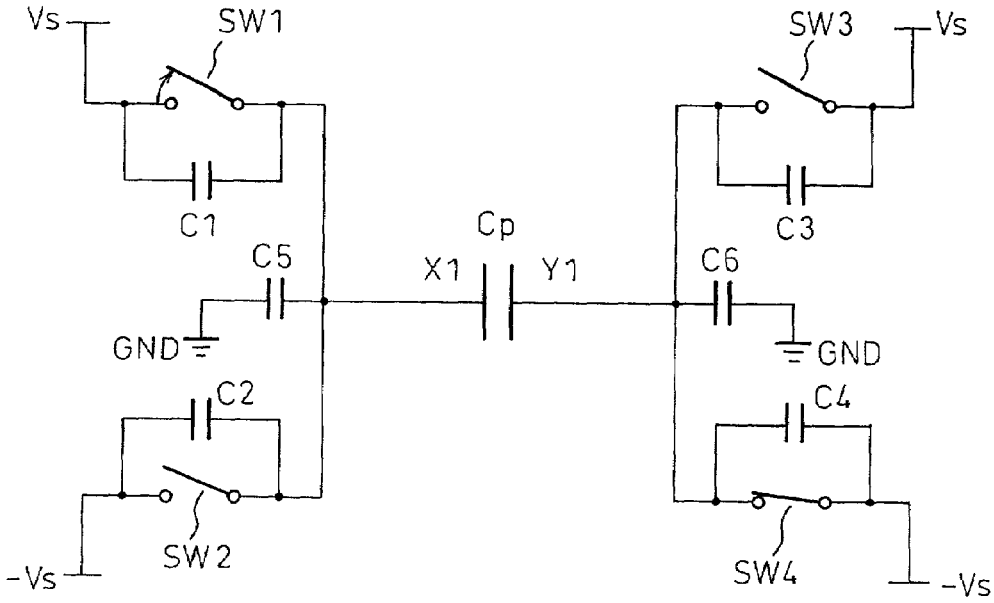
FIG. 29 is a diagram showing a voltage generation circuit used for the method of driving a PDP shown in FIG. 28.

FIG. 29 is a diagram showing a voltage generation circuit used for the method of driving a PDP shown in FIG. 28, and is mainly concerned with the period T3 of FIG. 28.

First, in the period T2 shown in FIG. 28, switches SW1 and SW4 are switched on and switches SW2 and SW3 are switched off, and a voltage Vs is applied to the X1-electrode and a voltage −Vs is applied to the Y1-electrode, so that a second time sustain discharge is caused on cells of the X1-Y1 electrodes. Further, in the period T3, the switch SW1 is switched off, so that the output circuit for the X1-electrode is changed to a high impedance state. Here, a cell positioned between the X1-electrode and the Y1-electrode has a capacitor Cp, the switches SW1 and SW2 also have capacitors C1 and C2, and further, a capacitor C5 is assumed to exist between the X1-electrode and the ground (GND). Therefore, a voltage (V1) of the X-electrode is changed to a voltage which is lower than the voltage Vs (for example, 80 V) by a specific voltage (for example, 20 to 30 V) due to the capacitors Cp, C1, C2 and C5. With regard to another voltages V2 to V4, the above voltage change is also caused in the voltages V2 to V4. Specifically, the voltages V2 and V4 are set to, for example, about 50 to 60 V, and the voltage V3 is set to, for example, about −50 to −60 V.

Therefore, according to the ninth embodiment, preferable voltages (for example, 50 to 60 V) can be applied to the X1-electrode as the voltage V1, without providing an exclusive power supply circuit. Here, values of the capacitors Cp, C1, C2 and C5 are different in each configuration of the PDP panel, and therefore, for example, the voltage V1 can be set at a preferable value by controlling the capacitance of the capacitor C5.

As described above, an effect of controlling a discharge growth is obtained by changing the output circuit to a high impedance state, as the applying voltage is changed toward a voltage to be suppress the discharge, when increasing a current flowing through the electrode of the high impedance state.

Figure 30:
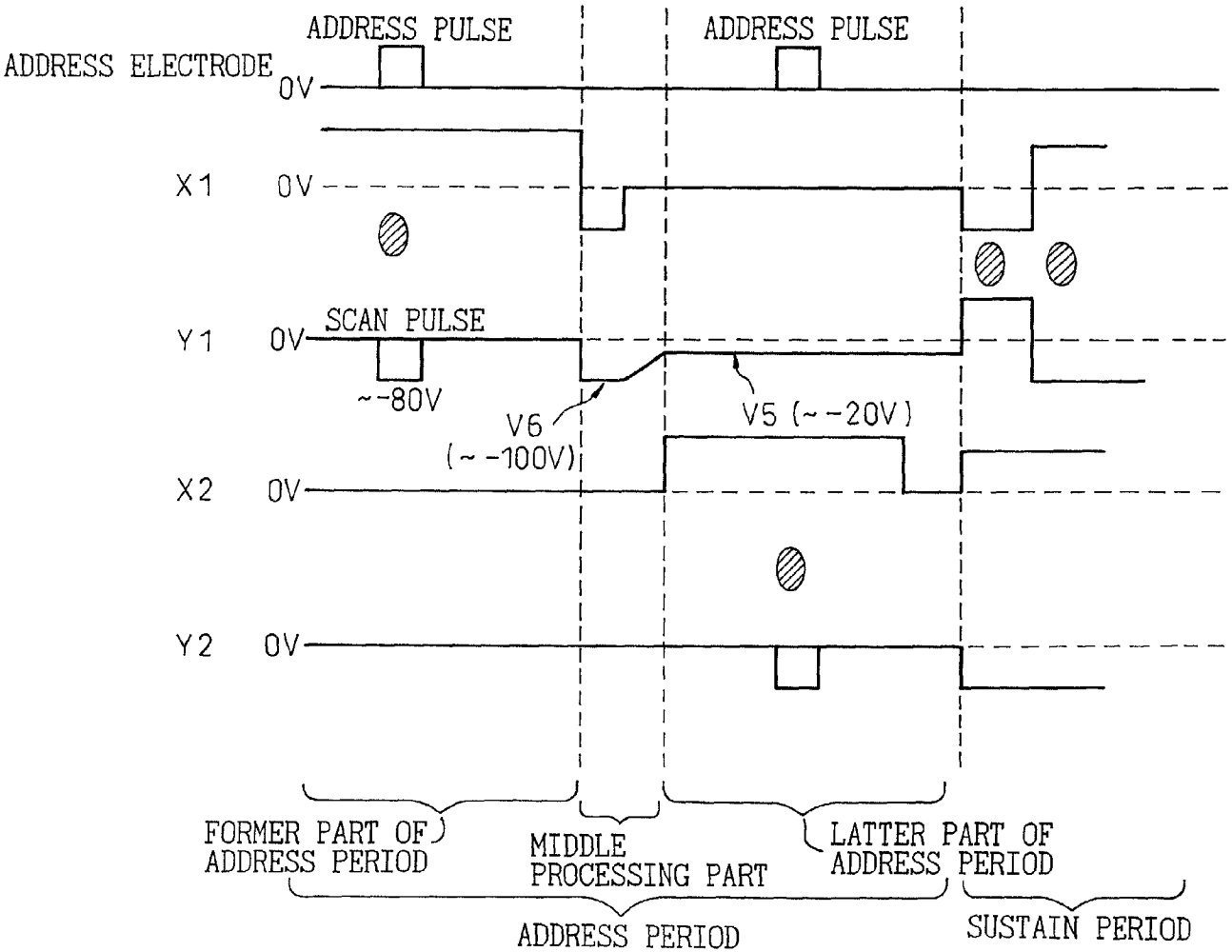
FIG. 30 is a diagram showing a driving waveform according to a tenth embodiment of a method of driving a PDP relating to the present invention.

FIG. 30 is a diagram showing a driving waveform, according to a tenth embodiment of a method of driving a PDP, relating to the present invention.

In the tenth embodiment, a wall charge for cells where an address discharge is not carried out is extinguished when a first half address period is finished. Concretely, for example, the address electrode is fixed at 0 V, and the Y-electrode is supplied with a pulse (V6: for example, −100 V) having a higher voltage or a larger pulse width than a Y scan pulse. According to this pulse V6, a discharge is caused on the cells even where the address discharge is not carried out, as the pulse V6 has the higher voltage than the scan pulse or the larger pulse width than the scan pulse. In this case, a voltage of the X-electrode is almost the same as that of the scan pulse, and the wall charge is generally not caused between the X-electrode and the Y-electrode and, thereafter, the cells positioned between the X-electrode and the Y-electrode are not lit (turned-on).

Here, the pulse (V6), which is applied during a middle processing part between a former part of the address period and a latter part of the address period, can be applied in each sub-field. Further, the pulse (V6) can also be applied in each group of a plurality of sub-fields (for example, each field).

Next, in an additional aspect of the present invention, the voltage of the Y1-electrode where an addressing process is carried out in the part of the address period is set to a voltage (V5: for example, −20 V) which is lower than 0 V in the latter part of the address period. Specifically, a positive wall charge is accumulated on the Y-electrode of the cells where an addressing discharge is carried out in the former part of the address period, and this positive wall charge is lowering a voltage so as not to be extinguished the wall charge by a discharge caused on the adjacent cell in the latter part of the address period. However, it is important to avoid extremely lowering the voltage, because there is the possibility to start a discharge between an address pulse and the extremely lowered voltages.

As described above in detail, according to the present invention, it is possible to prevent an abnormal discharge by avoiding a distorted accumulation of charges on the display panel of the PDP. Further, according to the present invention, it is possible to prevent an occurrence of an erroneous address by only the erasing pulse without the application of the address pulse during the address period.

Many different embodiments of the present invention may be constructed without departing from the spirit and scope of the present invention, and it should be understood that the present invention is not limited to the specific embodiments described in this specification, except as defined in the appended claims.

What is claimed is:

1. A method of driving a plasma display panel having a plurality of first electrodes, a plurality of second electrodes adjacently disposed alternately to said first electrodes, and a plurality of third electrodes formed to cross said first and second electrodes, comprising:

carrying out an address discharge between said second electrodes and said third electrodes;

carrying out an auxiliary discharge to decrease a volume of wall charges, accumulated on a display cell in which a sustain discharge is not intended, to a level that cannot generate the sustain discharge; and carrying out the sustain discharge by alternately applying sustain pulses to said first and second electrodes, wherein the auxiliary discharge is carried out by applying a voltage pulse, having the same polarity as the voltage pulse for carrying out the address discharge, between said second electrodes and said third electrodes.

2. A method of driving a plasma display panel having a plurality of first electrodes, a plurality of second electrodes adjacently disposed alternately to said first electrodes, and a plurality of third electrodes formed to cross said first and second electrodes, comprising:

oppositely driving said second electrodes into an odd electrode group and an even electrode group in temporal; and setting a voltage of any of said second electrodes finishing an address process lower than a non-selection voltage of said second electrode when carrying out the address process and after finishing an address period of one of said odd and even electrode groups.

3. A method of driving a plasma display panel having a plurality of first electrodes, a plurality of second electrodes adjacently disposed alternately to said first electrodes, and a plurality of third electrodes formed to cross said first and second electrodes, comprising:

dividing said first electrodes and said second electrodes into an odd electrode group and an even electrode group, wherein each adjacent odd electrode of said odd electrode group and each adjacent even electrode of said even electrode group or each adjacent odd and even electrode constitutes a display line;

separately carrying out in temporal a plurality of discharges of an initial stage of a sustain discharge period by each adjacent odd electrode or each adjacent even electrode; and setting low one or both voltages of said first electrodes and said second electrodes, where the sustain discharge is not carried out.

4. The method of driving the plasma display panel as claimed in claim 3, wherein a voltage applied to an electrode not carrying out a discharge is set low by bringing a driving circuit for said electrode into a high impedance state.

5. A method of driving a plasma display panel having a plurality of first electrodes, a plurality of second electrodes adjacently disposed alternately to said first electrodes, and a plurality of third electrodes formed to cross said first and second electrodes, comprising:

carrying out an address discharge between said second electrodes and said third electrodes;

carrying out a sustain discharge by alternately applying sustain pulses to said first and second electrodes; and carrying out an auxiliary discharge on a scale larger than the scale of the sustain discharge carried out immediately before, wherein the auxiliary discharge is carried out by generating a discharge in a selected cell by applying a voltage pulse, with said third electrodes set to have a first polarity and said second electrodes set to have a second polarity.

forming wall charges of said first polarity on at least said second electrodes, with said first electrodes set to have said first polarity with respect to said second electrodes, and forming wall charges of said second polarity on said first electrodes, and applying a voltage pulse to said third or second electrodes or to both electrodes so as to set said third electrodes to have said first polarity and to set said second electrodes to have said second polarity.

6. The method of driving the plasma display panel as claimed in claim 5, wherein a voltage to be applied to said third electrodes when carrying out the auxiliary discharge is equivalent to a voltage of a voltage pulse to be applied to said third electrodes in order to execute the address discharge during an address period.

7. The method of driving the plasma display panel as claimed in claim 5, wherein a voltage to be applied to said third electrodes when carrying out the auxiliary discharge has a polarity opposite to the polarity of the potentials of said second and third electrodes during a sustain discharge period.

8. The method of driving the plasma display panel as claimed in claim 5, wherein a voltage to be applied to said second electrodes when carrying out the auxiliary discharge is equivalent to a voltage selectively applied to said second electrodes at the time of carrying out the address discharge.

9. The method of driving the plasma display panel as claimed in claim 5, wherein a voltage to be applied to said first electrodes when carrying out the auxiliary discharge is a voltage having a polarity opposite to the polarity of said second electrodes.

10. The method of driving the plasma display panel as claimed in claim 9, wherein the voltage to be applied to said first electrodes when carrying out the auxiliary discharge is equivalent to a voltage to be applied to said first electrodes at the time of carrying out the address discharge.

11. The method of driving the plasma display panel as claimed in claim 5, wherein the auxiliary discharge is carried out once in a plurality of sub-fields.

12. The method of driving the plasma display panel as claimed in claim 11, wherein the auxiliary discharge is carried out once in one frame or once in one field.

13. The method of driving the plasma display panel as claimed in claim 5, wherein said first electrodes and said second electrodes are disposed alternately and in parallel, and said third electrodes are orthogonal to said first and second electrodes.

14. A method of driving a plasma display panel having a plurality of first electrodes, a plurality of second electrodes adjacently disposed and alternately to said first electrodes, and a plurality of third electrodes formed to cross said first and second electrodes, comprising:

carrying out an address discharge between said second electrodes and said third electrodes; and carrying out a sustain discharge by alternately applying sustain pulses to said first and second electrodes, wherein an auxiliary discharge is carried out, between said first electrodes and said third electrodes, and between the address discharge and the sustain discharge.

15. The method of driving the plasma display panel as claimed in claim 14, further comprising:

generating a discharge in a selected cell by applying a voltage pulse, with said third electrodes set to have a first polarity and said second electrodes set to have a second polarity;

carrying out the address discharge to form wall charges of a first polarity on at least said second electrodes, with said first electrodes set to have a first polarity with respect to said second electrodes, and also to form wall charges of a second polarity on said first electrodes; and applying a voltage pulse to said first or third electrodes or to both electrodes so as to set said third electrodes to have a first polarity and to set said first electrodes to have a second polarity, thereby to generate a discharge in a discharge cell that starts a discharge without application, to this cell, a voltage pulse that brings about the address discharge through said third electrodes.

16. The method of driving the plasma display panel as claimed in claim 14, wherein a voltage to be applied to said third electrodes when carrying out the auxiliary discharge is equivalent to a voltage of an address pulse for carrying out the address discharge.

17. The method of driving the plasma display panel as claimed in claim 14, wherein a voltage to be applied to said second electrodes when carrying out the auxiliary discharge is a voltage which decreases a potential difference between the voltage applied to said second electrodes and a voltage of an additional pulse to be applied to said first electrodes.

18. The method of driving the plasma display panel as claimed in claim 17, wherein the voltage to be applied to said second electrodes when carrying out the auxiliary discharge is equivalent to a voltage of a non-selected electrode of said second electrodes during an address period.

19. The method of driving the plasma display panel as claimed in claim 14, wherein said first electrodes and said second electrodes are disposed, in parallel, alternately and said third electrodes are orthogonal to said first and second electrodes.

20. The method of driving the plasma display panel as claimed in claim 14, comprising:

applying a voltage pulse, having the same polarity as a voltage pulse for carrying out the address discharge, between said second electrodes and said third electrodes; and carrying out a further auxiliary discharge to decrease the volume of wall charges, accumulated on a display cell in which a sustain discharge is not intended, without carrying out the address discharge.

21. The method of driving the plasma display panel as claimed in claim 20, further comprising:

applying a voltage pulse, having the same polarity as a voltage pulse for carrying out the address discharge between said first electrodes and said second electrodes and having a voltage waveform that finally becomes more than the voltage between said first electrodes and said second electrodes in the time of addressing; and carrying out a further auxiliary discharge to decrease the volume of wall charges, accumulated on a display cell in which a sustain discharge is not intended, without carrying out the address discharge.

22. The method of driving the plasma display panel as claimed in claim 21, wherein the voltage waveform applied between said first electrodes and said second electrodes when carrying out the further auxiliary discharge is a voltage waveform having a less steep inclination.

23. The method of driving the plasma display panel as claimed in claim 14, wherein said second electrodes are oppositely driven into an odd electrode group and an even electrode group in temporal and, after finishing an address period of one of said odd and even electrode groups, further comprising:

applying a voltage pulse, having the same polarity as a voltage pulse for carrying out the address discharge on said second electrodes and having the same or a higher voltage than that of a scan pulse; and carrying out a further auxiliary discharge to decrease the volume of wall charges, accumulated on a display cell in which a sustain discharge is not intended, without carrying out the address discharge.

24. The method of driving the plasma display panel as claimed in claim 23, wherein the voltage applied between said second electrodes and said first electrodes constituting a display line when carrying out the further auxiliary discharge is equivalent to a voltage applied to said second electrodes for carrying out the auxiliary discharge.

25. A plasma display panel comprising:

a plurality of first electrodes;

a plurality of second electrodes adjacently disposed alternately to said first electrodes;

a plurality of third electrodes formed to cross said first and second electrodes; and a control circuit for carrying out an address discharge between said second electrodes and said third electrodes, wherein said control circuit carries out an auxiliary discharge to decrease the volume of wall charges, accumulated on a display cell in which a sustain discharge is not intended, to a level which cannot generate a sustain discharge, and carries out a sustain discharge by alternately applying sustain pulses to said first and second electrodes, wherein the auxiliary discharge is carried out by applying a voltage pulse, having the same polarity as a voltage pulse for carrying out the address discharge, between said second electrodes and said third electrodes.

26. The plasma display panel as claimed in claim 25, wherein said first electrodes and said second electrodes are disposed alternately in parallel, and said third electrodes are orthogonal to said first and second electrodes.

27. A plasma display panel comprising:

a plurality of first electrodes;

a plurality of second electrodes adjacently disposed alternately to said first electrodes;

a plurality of third electrodes formed to cross said first and second electrodes; and a control circuit carrying out an address discharge between said second electrodes and said third electrodes, and carrying out an auxiliary discharge on a scale larger than the scale of a sustain discharge carried out immediately before, wherein the auxiliary discharge is carried out by generating a discharge in a selected cell by applying a voltage pulse, with said third electrodes set to have a first polarity and said second electrodes set to have a second polarity, forming wall charges of said first polarity on at least said second electrodes, with said first electrodes set to have said first polarity with respect to said second electrodes, and forming wall charges of said second polarity on said first electrodes; and applying voltage pulse to said third or second electrodes or to both electrodes so as to set said third electrodes to have said first polarity and to set said second electrodes to have said second polarity.

28. The plasma display panel as claimed in claim 27, wherein said first electrodes and said second electrodes are disposed alternately in parallel, and said third electrodes are orthogonal to said first and second electrodes.

29. A method of driving a plasma display panel having a plurality of first electrodes, a plurality of second electrodes adjacently disposed alternately to said first electrodes, and a plurality of third electrodes formed to cross said first and second electrodes, comprising:

generating a discharge in a selected cell by applying a voltage pulse, with said third electrodes set to have a first polarity and said second electrodes set to have a second polarity;

carrying out an address discharge between said second electrodes and said third electrodes, to form wall charges of a first polarity on at least said second electrodes, with said first electrodes set to have said first polarity with respect to said second electrodes, and to form wall charges having said second polarity on said first electrodes;

applying a voltage pulse to said first or third electrodes or to both electrodes so as to set said third electrodes to have said first polarity and to set said first electrodes to have said second polarity to generate a discharge in a discharge cell that starts a discharge without applying a voltage pulse that brings about the address discharge through said third electrodes;

carrying out an auxiliary discharge to decrease a volume of wall charges, accumulated on a display cell in which a sustain discharge is not intended, to a level that cannot generate said sustain discharge; and carrying out said sustain discharge by alternately applying sustain pulses to said first and second electrodes.

30. A method of driving a plasma display panel having a plurality of first electrodes, a plurality of second electrodes adjacently disposed alternately to said first electrodes, and a plurality of third electrodes formed to cross said first and second electrodes, comprising:

carrying out an address discharge between said second electrodes and said third electrodes;

carrying out an auxiliary discharge to decrease a volume of wall charges, accumulated on a display cell in which a sustain discharge is not intended, to a level which cannot generate said sustain discharge; and carrying out said sustain discharge by alternately applying sustain pulses to said first and second electrodes, wherein a voltage to be applied to said second electrodes, when carrying out the auxiliary discharge, is a voltage that decreases a potential difference between the voltage applied to said second electrodes and the voltage of an additional pulse to be applied to said first electrodes.

31. A plasma display panel comprising:

a plurality of first electrodes;

a plurality of second electrodes adjacently disposed alternately to said first electrodes;

a plurality of third electrodes formed to cross said first and second electrodes; and a control circuit carrying out an address discharge between said second electrodes and said third electrodes, carrying out a sustain discharge by alternately applying sustain pulses to said first and second electrodes, and carrying out an auxiliary discharge on a scale larger than the scale of the sustain discharge carried out immediately before, wherein the auxiliary discharge is carried out by generating a discharge in a selected cell by applying a voltage pulse, with said third electrodes set to have a first polarity and said second electrodes set to have a second polarity, forming wall charges of said first polarity on at least said second electrodes, with said first electrodes set to have said first polarity with respect to said second electrodes, forming wall charges of said second polarity on said first electrodes, and applying a voltage pulse to said third or second electrodes or to both electrodes so as to set said third electrodes to have said first polarity and to set said second electrodes to have said second polarity.

32. A plasma display panel comprising:

a plurality of first electrodes;

a plurality of second electrodes adjacently disposed alternately to said first electrodes;

a plurality of third electrodes formed to cross said first and second electrodes; and a control circuit carrying out an address discharge between said second electrodes and said third electrodes, wherein said control circuit carries out a sustain discharge by alternately applying sustain pulses to said first and second electrodes, and carries out an auxiliary discharge between said first electrodes and said third electrodes, between the address discharge and the sustain discharge.

* * * * *

UNITED STATES PATENT AND TRADEMARK OFFICE

CERTIFICATE OF CORRECTION

PATENT NO. : 7,006,060 B2
APPLICATION NO. : 09/998897
DATED : February 28, 2006
INVENTOR(S) : Yoshikazu Kanazawa et al.

It is certified that error appears in the above-identified patent and that said Letters Patent is hereby corrected as shown below:

Column 21, line 14, after “polarity” delete “.” and insert -- , --

Column 22, line 5, after “out” delete “,”

Signed and Sealed this

Tenth Day of October, 2006

JON W. DUDAS
*Director of the United States Patent and Trademark Office*